US011878886B2

(12) United States Patent
Okada et al.

(10) Patent No.: US 11,878,886 B2
(45) Date of Patent: Jan. 23, 2024

(54) SHEET FEEDING DEVICE AND IMAGE FORMING APPARATUS INCORPORATING SAME

(71) Applicants: Katsumi Okada, Kanagawa (JP); Takuya Moriyama, Kanagawa (JP); Kenichiroh Yamahiro, Kanagawa (JP)

(72) Inventors: Katsumi Okada, Kanagawa (JP); Takuya Moriyama, Kanagawa (JP); Kenichiroh Yamahiro, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 319 days.

(21) Appl. No.: 17/322,756

(22) Filed: May 17, 2021

(65) Prior Publication Data

US 2021/0371227 A1 Dec. 2, 2021

(30) Foreign Application Priority Data

May 26, 2020 (JP) ..... 2020-091646

(51) Int. Cl.
*B65H 23/00* (2006.01)
*B65H 7/08* (2006.01)

(52) U.S. Cl.
CPC ..... *B65H 23/005* (2013.01); *B65H 7/08* (2013.01); *B65H 2601/11* (2013.01)

(58) Field of Classification Search
CPC ..... B65H 59/38; B65H 59/06; B65H 59/02; B65H 2515/314; B65H 2515/31; B65H 2511/14; B65H 23/1806; B65H 23/005; B65H 16/106; B65H 23/038; B65H 2601/11; B65H 7/08; B41J 11/42
(Continued)

(56) References Cited

U.S. PATENT DOCUMENTS

2013/0221054 A1 8/2013 Ogawa
2014/0151491 A1 6/2014 Mizutani et al.
(Continued)

FOREIGN PATENT DOCUMENTS

JP 2018-150107 9/2018
JP 2018-150112 9/2018
(Continued)

OTHER PUBLICATIONS

European Search Report; Application 21174297.8; dated Oct. 22, 2021.

*Primary Examiner* — Thomas A Morrison
(74) *Attorney, Agent, or Firm* — Duft & Bornsen, PC

(57) ABSTRACT

A sheet feeding device includes a support, a rotation driver, a guide, a support shaft, a biasing member, a leading end sensor, a roller, an outer diameter sensor, and circuitry. The circuitry causes the rotation driver to rotate a spool in a winding direction to determine a timing at which a signal change rate exceeds a change rate threshold as a passing time at which a leading end of a continuous sheet passes through the leading end sensor, causes the rotation driver to rotate the spool by a rotation angle in the winding direction, from the passing time, to position the leading end of the continuous sheet at a feeding start position, and rotates the spool in a feeding direction to feed the continuous sheet from the feeding start position along a guide portion. Further, the circuitry changes the change rate threshold based on an outer diameter of a roll.

13 Claims, 16 Drawing Sheets

(58) Field of Classification Search
USPC ..... 242/413.2, 413.3, 419.2
See application file for complete search history.

(56) References Cited

U.S. PATENT DOCUMENTS

| | | | | |
|---|---|---|---|---|
| 2016/0136980 | A1* | 5/2016 | Kobayashi | B65H 23/16 226/91 |
| 2018/0257403 | A1* | 9/2018 | Yasuda | B41J 11/0045 |
| 2018/0257406 | A1* | 9/2018 | Harigae | B41J 15/04 |
| 2018/0257892 | A1* | 9/2018 | Eiyama | B41J 11/70 |
| 2018/0257893 | A1* | 9/2018 | Suzuki | B41J 11/0095 |
| 2020/0254793 | A1* | 8/2020 | Fukuoka | B65H 23/005 |
| 2021/0284475 | A1* | 9/2021 | Shimamura | B65H 19/105 |
| 2021/0284476 | A1* | 9/2021 | Harigae | B65H 23/16 |

FOREIGN PATENT DOCUMENTS

| | | | |
|---|---|---|---|
| JP | 2020-52850 | * | 4/2020 |
| WO | 2021148870 | A1 | 7/2021 |

* cited by examiner

FIG. 15

| DIAMETER D | SHEET THICKNESS w | FIRST THRESHOLD | SECOND THRESHOLD | ROTATION ANGLE $\theta$ | NUMBER OF ROTATIONS S |
|---|---|---|---|---|---|
| SMALL | THIN PAPER | 3.0 | 5.0 | 345° | 8 |
| | PLAIN PAPER | 3.5 | 5.5 | | |
| | THICK PAPER | 4.5 | 6.5 | | |
| MEDIUM | THIN PAPER | 3.5 | 5.5 | 350° | 5 |
| | PLAIN PAPER | 4.0 | 6.0 | | |
| | THICK PAPER | 5.0 | 7.0 | | |
| LARGE | THIN PAPER | 4.5 | 6.5 | 355° | 2 |
| | PLAIN PAPER | 5.0 | 7.0 | | |
| | THICK PAPER | 6.0 | 8.0 | | |

SHEET FEEDING DEVICE AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2020-091646, filed on May 26, 2020, in the Japan Patent Office, the entire disclosure of which is hereby incorporated by reference herein.

BACKGROUND

Technical Field

Embodiments of the present disclosure relate to a sheet feeding device and an image forming apparatus incorporating the sheet feeding device.

Description of the Related Art

There is known an image forming apparatus that forms an image on a long sheet (hereinafter, referred to as a "continuous sheet") wound around a spool. The image forming apparatus using the continuous sheet includes a sheet feeding mechanism. A user manually inserts a leading end of the continuous sheet into a sheet feeding portion of the sheet feeding mechanism, and then the image forming apparatus performs a sheet feeding operation after detecting the leading end.

SUMMARY

Embodiments of the present disclosure describe an improved sheet feeding device that includes a support, a rotation driver, a guide, a support shaft, a biasing member, a leading end sensor, a roller, an outer diameter sensor, and circuitry. The support detachably supports a roll formed of a continuous sheet wound around a spool. The rotation driver rotates the spool supported by the support in a feeding direction and a winding direction of the continuous sheet. The guide includes a facing portion that faces an outer circumferential surface of the roll and a guide portion that extends downstream from the facing portion in the feeding direction. The support shaft swingably supports the guide around a downstream end of the guide in the feeding direction, in a direction in which the facing portion contacts and separates from the roll. The biasing member presses the guide in a direction in which the facing portion approaches the roll. The leading end sensor retractably projects from the facing portion toward the roll to contact the roll and outputs a detection signal having a signal level in response to an amount of projection of the leading end sensor. The roller supported by the facing portion contacts the outer circumferential surface of the roll at a different position from the leading end sensor in a circumferential direction of the roll. The outer diameter sensor detects an outer diameter of the roll. The circuitry controls the rotation driver based on a signal change rate that is an amount of change in the signal level of the detection signal per unit time and a detection result of the outer diameter sensor. The circuitry causes the rotation driver to rotate the spool in the winding direction to determine a timing at which the signal change rate exceeds a change rate threshold as a passing time at which a leading end of the continuous sheet passes through the leading end sensor. Further, the circuitry causes the rotation driver to rotate the spool by a predetermined angle in the winding direction, from the passing time, to position the leading end at a feeding start position that is upstream from the leading end sensor and the roller in the winding direction and facing the guide portion, and causes the rotation driver to rotate the spool in the feeding direction to feed the continuous sheet from the feeding start position along the guide portion. The circuitry changes the change rate threshold based on the outer diameter of the roll detected by the outer diameter sensor.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 15 is a table illustrating a relation between the outer diameter and a sheet thickness, and a first threshold, a second threshold, the rotation angle, and the number of rotations.

Figure 1:
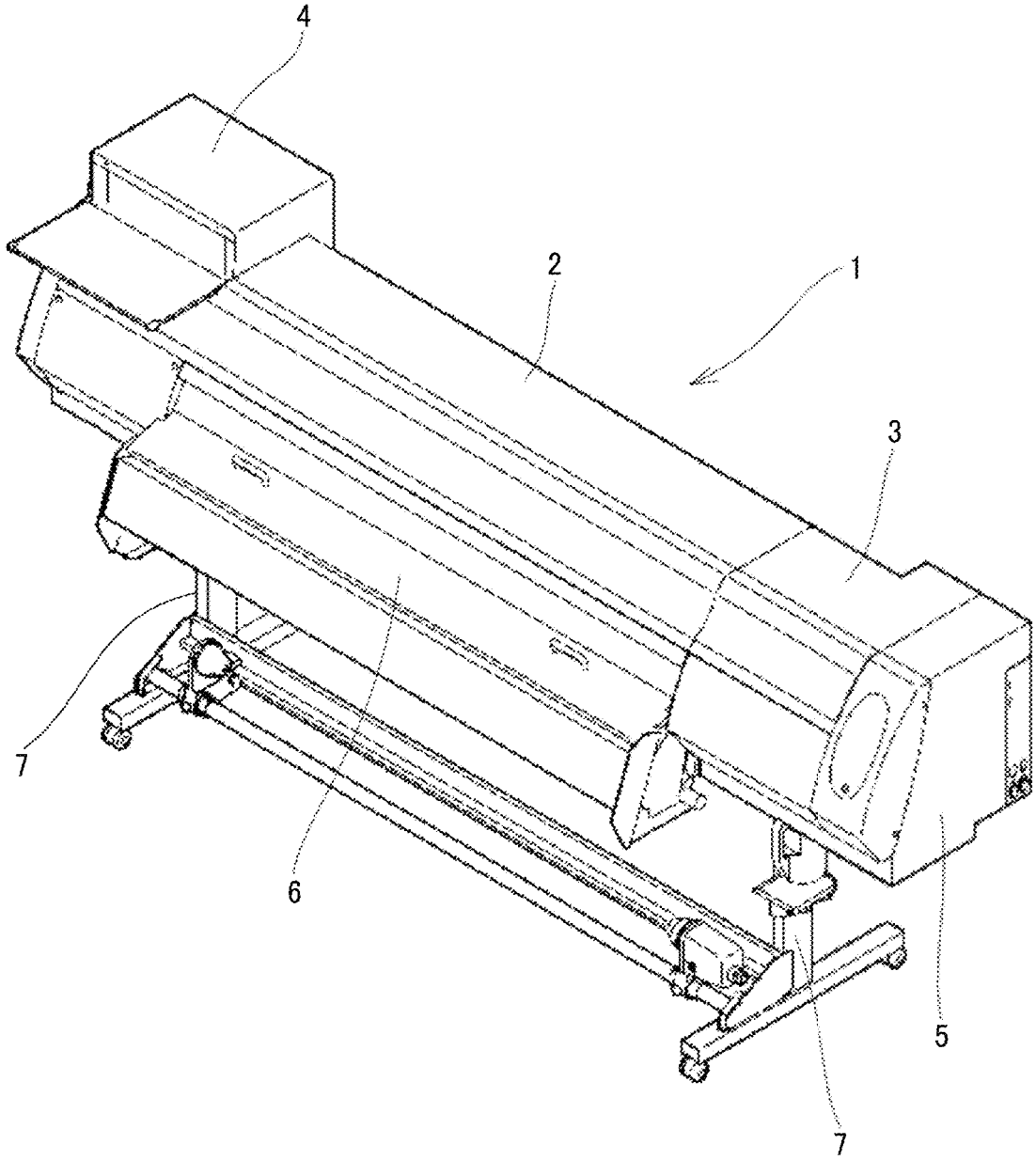
FIG. 1 is an exterior perspective view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes y, m, c, and k attached to each reference numeral indicate only that components indicated thereby are used for forming yellow, magenta, cyan, and black images, respectively, and hereinafter may be omitted when color discrimination is not necessary.

Figure 2:
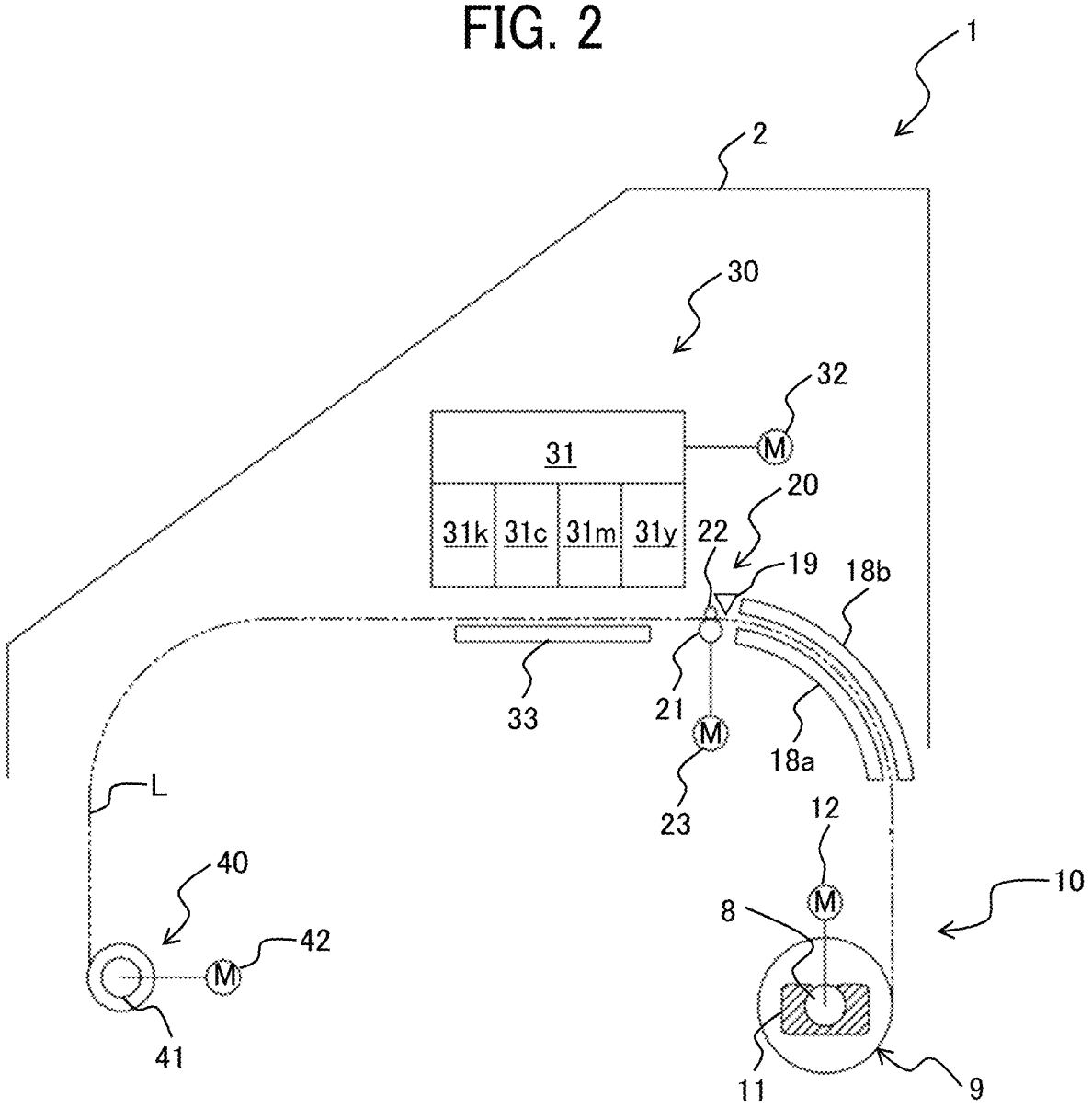
FIG. 2 is a cross-sectional view illustrating an interior of the image forming apparatus.

Hereinafter, a description is given of an image forming apparatus 1 according to an embodiment of the present disclosure with reference to FIGS. 1 and 2. FIG. 1 is an exterior perspective view of the image forming apparatus 1 according to the present embodiment. FIG. 2 is a cross-sectional view illustrating an interior of the image forming apparatus 1.

As illustrated in FIG. 1, a housing of the image forming apparatus 1 has an exterior constructed of a center cover 2, a right cover 3 and a left cover 4 disposed on the left and right of the center cover 2, side plates 5 disposed at ends of the right cover 3 and the left cover 4, and an operation cover 6 that opens and closes respect to the center cover 2. An apparatus body of the image forming apparatus 1 covered with the respective covers 2 to 6 is supported by left and right legs 7 with casters.

The image forming apparatus 1 according to the present embodiment is an image forming apparatus using an inkjet method that discharges ink onto a continuous sheet P (long sheet) to form an image on the continuous sheet P. A method of image formation used by the image forming apparatus 1 is not limited to the inkjet method, and an electrophotographic method can be used. As illustrated in FIG. 2, the image forming apparatus 1 mainly includes a sheet feeding device 10, a conveyance unit 20, an image forming unit 30, a winding unit 40, and a controller 50 (see FIG. 9).

The sheet feeding device 10 feeds the continuous sheet P wound around a spool 8 to the conveyance unit 20 through a conveyance path L. The conveyance path L is a space through which the continuous sheet P passes inside the image forming apparatus 1. More specifically, the conveyance path L is a route from the sheet feeding device 10 to the winding unit 40 via the conveyance unit 20 and the image forming unit 30. Details of the sheet feeding device 10 is described later with reference to FIGS. 3 to 8.

The conveyance unit 20 conveys the continuous sheet P, which is fed from the sheet feeding device 10 through the conveyance path L, to the winding unit 40 through a position facing the image forming unit 30. The conveyance unit 20 mainly includes a conveyance roller 21, a pressure roller 22, and a conveyance motor 23. The conveyance roller 21 and the pressure roller 22 rotate while nipping the continuous sheet P from both sides in the direction of thickness of the continuous sheet P. The conveyance motor 23 transmits a driving force to rotate the conveyance roller 21. The pressure roller 22 is pressed against the conveyance roller 21 with a predetermined pressure and rotated along with the rotation of the conveyance roller 21.

The image forming unit 30 is disposed downstream from the conveyance unit 20 in the direction of conveyance of the continuous sheet P. The image forming unit 30 discharges ink onto the continuous sheet P conveyed by the conveyance unit 20 to form an image on the continuous sheet P. The image forming unit 30 mainly includes a carriage 31, a main scanning motor 32, and a platen 33.

As the main scanning motor 32 transmits a driving force, the carriage 31 reciprocates in the main scanning direction perpendicular to the direction of conveyance of the continuous sheet P. The carriage 31 includes recording heads 31*k*, 31*c*, 31*m*, and 31*y* that discharge inks of respective colors of black, cyan, magenta, and yellow. The recording heads 31*k*, 31*c*, 31*m*, and 31*y* discharge the inks of the respective colors toward the continuous sheet P supported by the platen 33 in accordance with instructions from the controller 50. The platen 33 upwardly faces the carriage 31. The platen 33 supports the continuous sheet P conveyed by the conveyance unit 20.

The winding unit 40 is disposed downstream from the conveyance unit 20 and the image forming unit 30 in the direction of conveyance of the continuous sheet P. The winding unit 40 winds the continuous sheet P on which an image has been formed by the image forming unit 30. The winding unit 40 mainly includes a winding roller 41 and a winding motor 42. As the winding motor 42 transmits a driving force, the winding roller 41 rotates to wind the continuous sheet P on which the image has been formed.

Figure 16A:
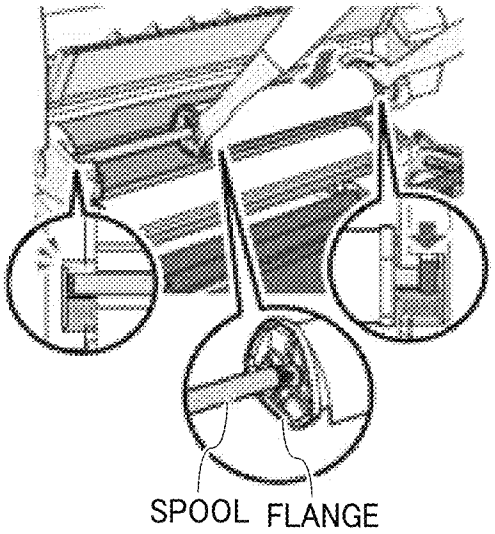
FIGS. 16A to 16E are schematic views for explaining a comparative method of setting a rolled sheet.
Figure 16B:
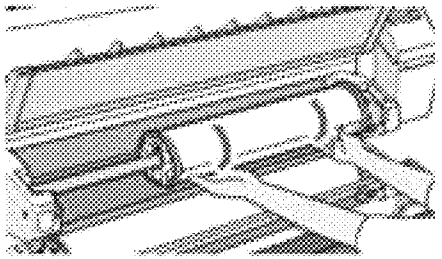
Figure 16C:
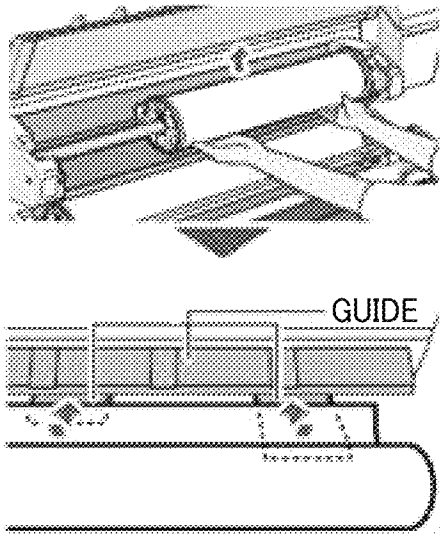

Here, a comparative method of setting a rolled sheet is described. FIGS. 16A to 16E are schematic views for explaining the comparative method of setting the rolled sheet. The rolled sheet is provided with flanges at the ends in a width direction of the rolled sheet, and a spool is set into the rolled sheet. A user sets the rolled sheet with the spool in a sheet holding portion (spool bearing mount) of an apparatus as illustrated in FIG. 16A, searches for a leading end of a continuous sheet of the rolled sheet, holds the rolled sheet with both hands as illustrated in FIG. 16B while keeping an eye on the leading end, and rotates the rolled sheet so that the leading end of the continuous sheet reaches the front side. Next, the user guides the leading end of the continuous sheet between guide plates disposed on the back side of the rolled sheet and inserts the leading end while rotating the rolled sheet as illustrated in FIG. 16C. When the user inserts the leading end of the continuous sheet into the back of the guide plates, the apparatus holds the leading end and pulls the continuous sheet therein.

As illustrated in FIG. 16C, since the guide plates between which the leading end of the continuous sheet is inserted is located on the back side of the rolled sheet, the guide plates are hidden behind the rolled sheet. Accordingly, it is difficult for the user to see the guide plates and confirm whether the leading end has been inserted between the guide plates. In addition, the user is required to insert the leading end of the continuous sheet of the rolled sheet as evenly as possible, which is a delicate operation. If the leading end of the continuous sheet is not inserted evenly, the continuous sheet is fed obliquely, which may cause skew or jam of the continuous sheet, and the user may have to reset the rolled sheet.

Figure 16D:
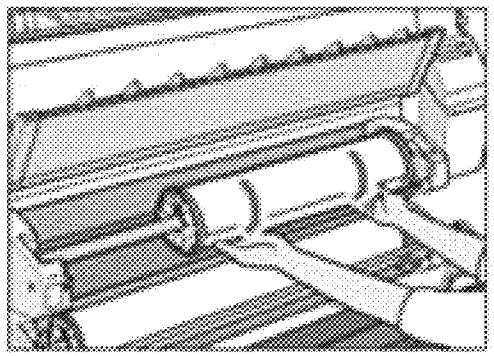
Figure 16E:
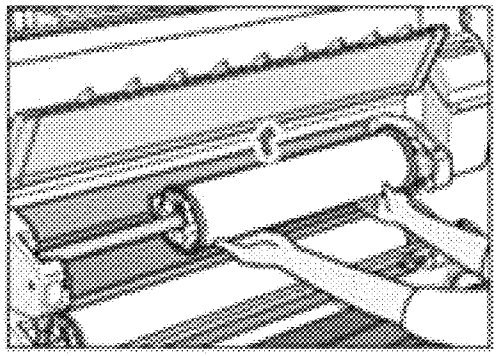

Further, as illustrated in FIGS. 16D and 16E, when the apparatus includes two-stage rolled sheet mounts, if the rolled sheet is set on the upper stage, it is more difficult for the user to see the guide plates and insert the leading end between the guide plates because of the rolled sheet on the upper stage, which may increase the difficulty in setting the rolled sheet and the possibility of oblique insertion.

Figure 3:
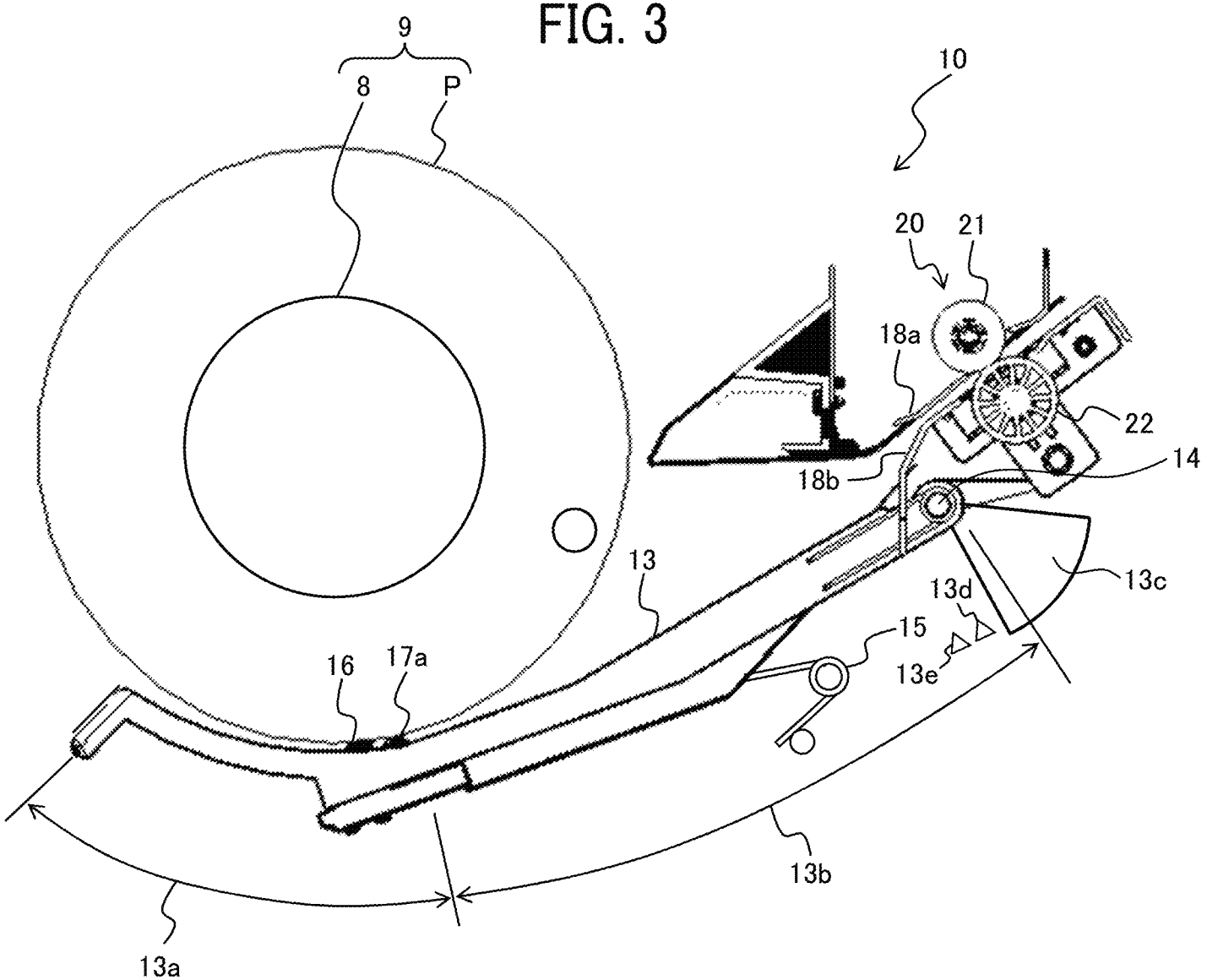
FIG. 3 is a schematic view illustrating a configuration of a sheet feeding device of the image forming apparatus.
Figure 4:
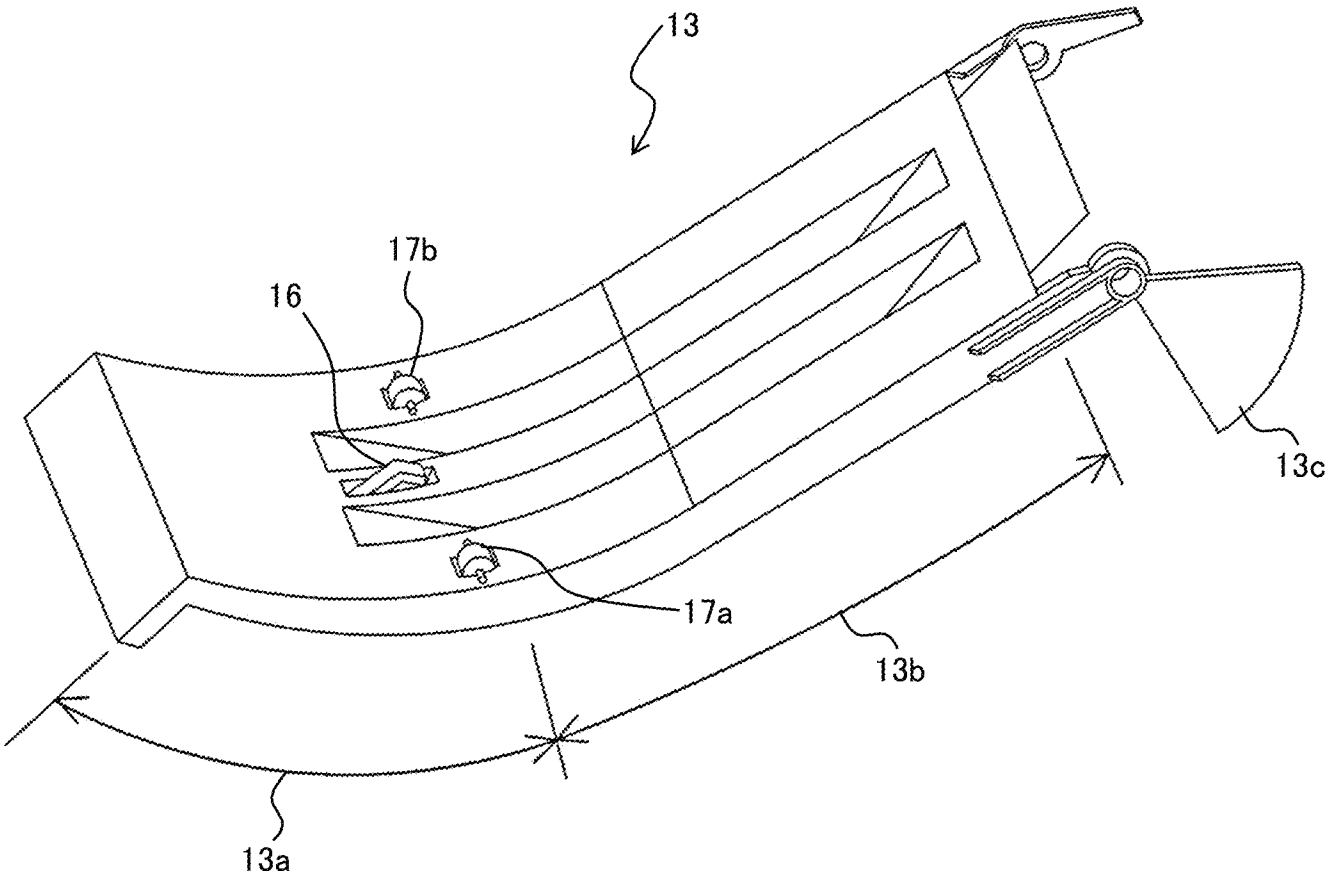
FIG. 4 is a perspective view of a guide arm of the sheet feeding device.

FIG. 3 is a schematic view illustrating a configuration of the sheet feeding device 10. FIG. 4 is a perspective view of a guide arm 13 of the sheet feeding device 10. As illustrated in FIGS. 2 to 4, the sheet feeding device 10 mainly includes a support 11, a feed motor 12 as a rotation driver, the guide arm 13 as a guide, a support shaft 14, a coil spring 15 as a biasing member, a leading end sensor 16, multiple rollers 17*a* and 17*b*, guide plates 18*a* and 18*b*, and a sheet detection sensor 19.

The support 11 detachably supports a roll 9. The roll 9 is a rolled sheet formed by winding the continuous sheet P around the spool 8 having a shaft shape. More specifically, the support 11 rotatably supports both ends of the spool 8. The feed motor 12 rotates the spool 8 supported by the support 11 forward in the counterclockwise direction in FIG. 3, that is, in a feeding direction to feed the continuous sheet P from the roll 9, and rotates the spool 8 in reverse in the clockwise direction in FIG. 3, that is, in a winding direction to wind the continuous sheet P.

The guide arm 13 brings the leading end sensor 16 and the rollers 17*a* and 17*b* into contact with the roll 9 and guides the continuous sheet P fed from the roll 9 between the guide plates 18*a* and 18*b*. The guide arm 13 has an elongated plate shape. The guide arm 13 includes a facing portion 13*a*, a guide portion 13*b*, and a detected portion 13*c*.

The facing portion 13*a* has an arc shape along the outer circumferential surface of the roll 9. The facing portion 13*a* faces the outer circumferential surface of the roll 9 below a horizontal line passing through the center of rotation of the spool 8. More specifically, the facing portion 13*a* faces a region (lower region) including the lower end of the roll 9. The guide portion 13*b* extends downstream from the facing portion 13*a* in the feeding direction of the continuous sheet P. More specifically, the guide portion 13*b* extends from the facing portion 13*a* to a position between the guide plates 18*a* and 18*b*.

The detected portion 13*c* extends from the position of the support shaft 14 in a different direction from the guide portion 13*b*. The detected portion 13*c* swings around the support shaft 14 together with the facing portion 13*a* and the guide portion 13*b*. Outer diameter sensors 13*d* and 13*e* read the detected portion 13*c* to measure an outer diameter D of the roll 9.

The outer diameter sensors 13*d* and 13*e* are disposed separately from each other on the trajectory of swing of the detected portion 13*c*. The outer diameter sensors 13*d* and 13*e* are secured inside the covers 2 to 6. That is, the outer diameter sensors 13*d* and 13*e* do not move along with the swing of the detected portion 13*c*. Each of the outer diameter sensors 13*d* and 13*e* is, for example, an optical sensor including a light emitting unit and a light receiving unit that face each other across the trajectory of the swing of the detected portion 13*c*.

Each of the outer diameter sensors 13*d* and 13*e* outputs a detection signal to the controller 50 when the optical path from the light emitting unit to the light receiving unit is blocked by the detected portion 13*c*. On the other hand, each of the outer diameter sensors 13*d* and 13*e* does not output the detection signal to the controller 50 when the optical path from the light emitting portion to the light receiving portion is not blocked by the detected portion 13*c*. However, the outer diameter sensors 13*d* and 13*e* are not limited to such a configuration.

The support shaft 14 extends in the same direction as the longitudinal direction of the spool 8 supported by the support 11. The support shaft 14 is secured inside the covers 2 to 6. The support shaft 14 is attached to a downstream end of the guide portion 13*b* in the feeding direction of the continuous sheet P, and swingably supports the guide arm 13. That is, the guide arm 13 is swingable around the support shaft 14 so that the facing portion 13*a* contacts and separates from the roll 9. The coil spring 15 presses the guide arm 13 in a direction in which the facing portion 13*a* approaches the roll 9.

The leading end sensor 16 projects from the facing portion 13*a* toward the roll 9. The leading end sensor 16 is supported by the facing portion 13*a* and retractable with respect to the facing portion 13*a*. Further, the leading end sensor 16 is biased in a direction in which the leading end sensor 16 comes into contact with the outer circumferential surface of the roll 9, that is, in a direction in which the leading end sensor 16 projects from the facing portion 13*a*. The leading end sensor 16 outputs a detection signal to the controller 50. The detection signal has a signal level in response to an amount of projection of the leading end sensor 16 from the facing portion 13*a*. More specifically, the signal level of the detection signal increases as the amount of projection increases, and decreases as the amount of projection decreases.

The rollers 17*a* and 17*b* are rotatably supported by the facing portion 13*a*. The axis of rotation of the rollers 17*a* and 17*b* extends in the same direction as the longitudinal direction of the spool 8 and the support shaft 14. The rollers 17*a* and 17*b* are disposed at a different position from the leading end sensor 16 in a circumferential direction of the roll 9. More specifically, the rollers 17*a* and 17*b* are disposed upstream from the leading end sensor 16 in the winding direction. Further, the rollers 17*a* and 17*b* are disposed separately from each other in the width direction perpendicular to the circumferential direction of the roll 9. More specifically, the leading end sensor 16 is disposed between the roller 17*a* and the roller 17*b* in the width direction.

The guide plates 18*a* and 18*b* are disposed downstream from the guide arm 13 in the feeding direction of the continuous sheet P. The guide plates 18*a* and 18*b* face each other across the conveyance path L. The continuous sheet P moves along the guide arm 13, passes between the guide plates 18*a* and 18*b*, and enters the conveyance unit 20. That is, the guide plates 18*a* and 18*b* serve as a sheet feeding portion into which the continuous sheet P fed from the roll 9 enters.

As illustrated in FIG. 2, the sheet detection sensor 19 is disposed downstream from the guide portion 13*b* in the feeding direction of the continuous sheet P. More specifically, the sheet detection sensor 19 is disposed downstream from the guide plates 18*a* and 18*b* and upstream from the conveyance unit 20 in the feeding direction. The sheet detection sensor 19 outputs a detection signal to the controller 50 when the continuous sheet P is present at the installation position of the sheet detection sensor 19 (i.e., when the sheet detection sensor 19 detects the continuous sheet P). The sheet detection sensor 19 does not output the detection signal when the continuous sheet P is absent at the installation position (i.e., when the sheet detection sensor 19 does not detect the continuous sheet P).

Figure 5:
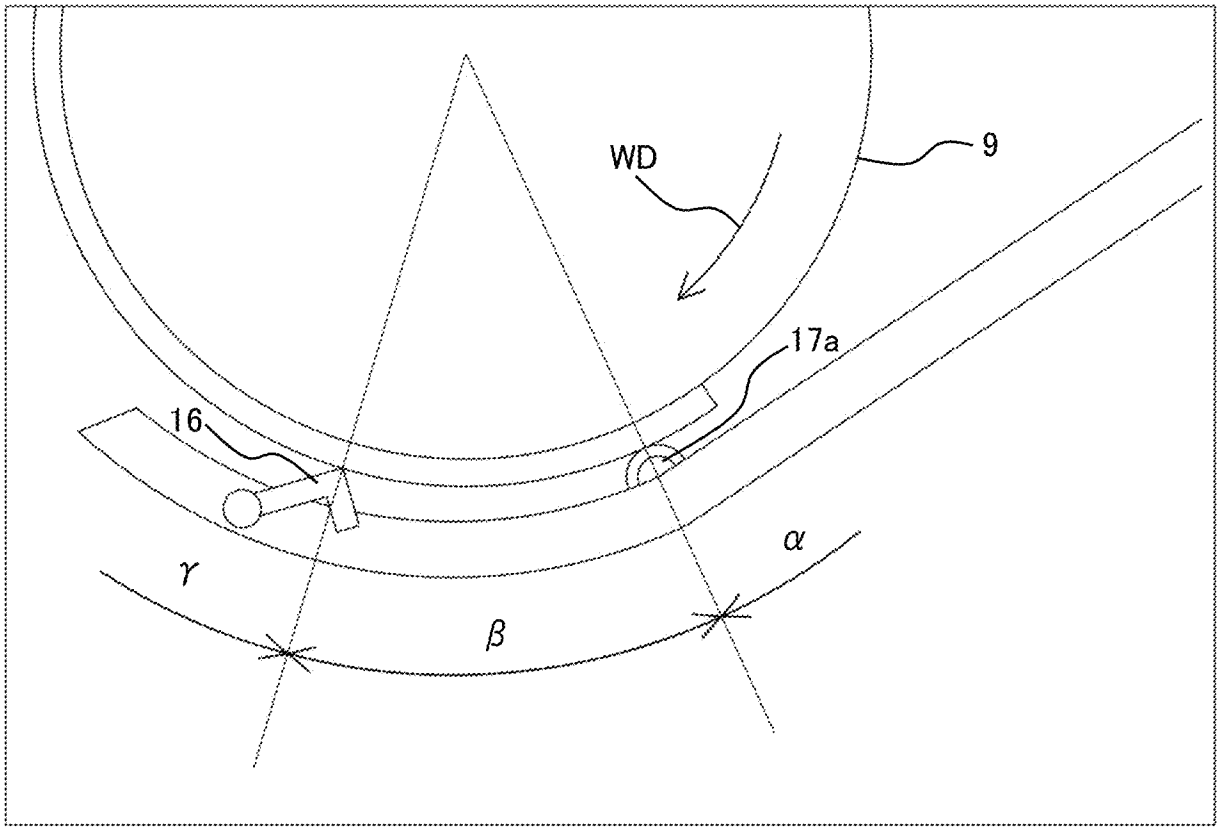
FIG. 5 is an enlarged view of a facing portion of the guide arm and the surrounding thereof.
Figure 6A:
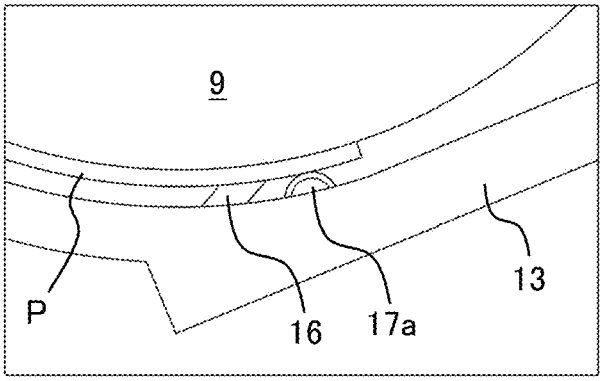
FIGS. 6A to 6C are diagrams illustrating a positional relation between a leading end of a continuous sheet, a leading end sensor, and a roller in the sheet feeding device.
Figure 6B:
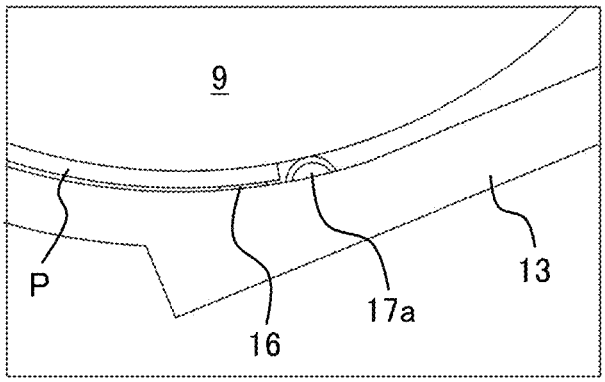
Figure 6C:
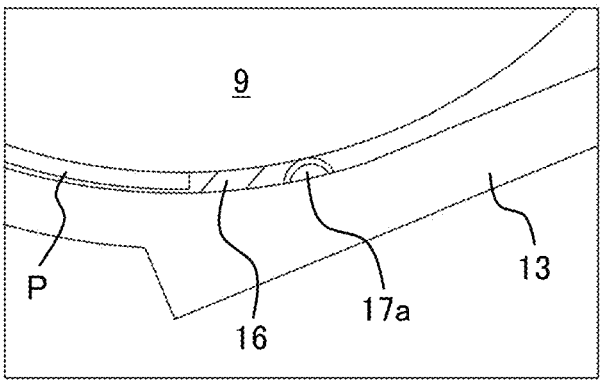
Figure 7A:
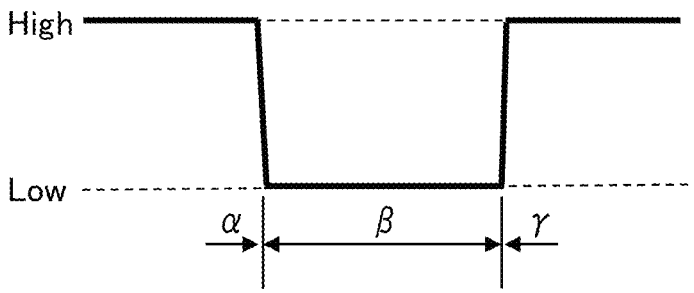
FIGS. 7A and 7B are diagrams illustrating change of a signal level of a detection signal of the leading end sensor.
Figure 7B:
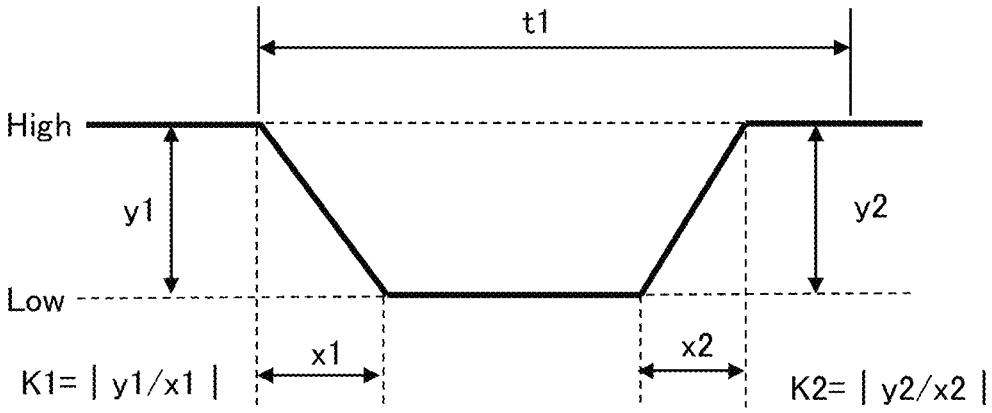

Next, a description is given of a relation between the position of the leading end of the continuous sheet P and the signal level of the detection signal when the spool 8 rotates in the winding direction with reference to FIGS. 5 to 7B. FIG. 5 is an enlarged view of the facing portion 13*a* and the surrounding thereof. FIGS. 6A to 6C are diagrams illustrating a positional relation between the leading end of the continuous sheet P, the leading end sensor 16, and the roller 17*a*. FIGS. 7A and 7B are diagrams illustrating change of the signal level of the detection signal of the leading end sensor 16.

Since the guide arm 13 is biased by the coil spring 15 in the direction in which the guide arm 13 approaches the roll 9, as illustrated in FIG. 5, the leading end sensor 16 and the rollers 17*a* and 17*b* contact the outer circumferential surface of the roll 9. As the spool 8 rotates in the winding direction indicated by arrow WD in FIG. 5, the leading end of the continuous sheet P that is in close contact with the outer circumferential surface of the roll 9 passes through the rollers 17*a* and 17*b*, and then passes through the leading end sensor 16.

As illustrated in FIGS. 6A and 6B, when the leading end of the continuous sheet P passes through the rollers 17*a* and 17*b*, the guide arm 13 swings by the thickness of the continuous sheet P, and the rollers 17*a* and 17*b* come into contact with the outer circumferential surface of the roll 9. As a result, the leading end sensor 16 retracts in the facing portion 13*a* by the thickness of the continuous sheet P. That is, when the leading end of the continuous sheet P passes through the rollers 17*a* and 17*b*, the amount of projection of the leading end sensor 16 decreases.

As a result, as illustrated in FIG. 7A, the detection signal of the leading end sensor 16 is High signal before the leading end of the continuous sheet P passes through the rollers 17*a* and 17*b* (region α), and is Low signal after the leading end of the continuous sheet P passes through the rollers 17*a* and 17*b* (region β). The High signal has a higher signal level than the Low signal. That is, the signal level of the detection signal of the leading end sensor 16 decreases as the leading end of the continuous sheet P passes through the rollers 17*a* and 17*b*.

Next, as illustrated in FIGS. 6B and 6C, when the leading end of the continuous sheet P passes through the leading end sensor 16, the leading end sensor 16 projects from the facing portion 13*a* by the thickness of the continuous sheet P. That is, when the leading end of the continuous sheet P passes through the leading end sensor 16, the amount of projection of the leading end sensor 16 increases.

As illustrated in FIG. 7A, the detection signal of the leading end sensor 16 becomes the High signal after the leading end of the continuous sheet P passes through the leading end sensor 16 (region γ). That is, the signal level of the detection signal of the leading end sensor 16 increases as the leading end of the continuous sheet P passes through the leading end sensor 16.

Here, the change in the signal level of the detection signal is microscopically observed in FIG. 7B. When the leading end of the continuous sheet P passes through the rollers 17*a* and 17*b*, the detection signal of the leading end sensor 16 decreases by the signal level y1 during the time x1 as illustrated in FIG. 7B. When the leading end of the continuous sheet P passes through the leading end sensor 16, the detection signal of the leading end sensor 16 increases by the signal level y2 during the time x2.

Hereinafter, the amount of change in the signal level of the detection signal per unit time is referred to as a "signal change rate". The signal change rate when the leading end sensor 16 retracts is referred to as a first change rate, and the signal change rate when the leading end sensor 16 projects is referred to as a second change rate. That is, the first change rate and the second change rate are opposite in the direction of change of the signal level.

The first change rate K1 is defined by expression of $K1=|y1/x1|$. The first change rate K1 exceeds a predetermined first threshold when the leading end of the continuous sheet P passes through the rollers 17*a* and 17*b*. The second change rate K2 is defined by expression of $K2=|y2/x2|$. The second change rate K2 exceeds a predetermined second threshold when the leading end of the continuous sheet P passes through the leading end sensor 16. The first threshold and the second threshold are thresholds for absorbing small variations in the diameter of the roll 9. The first threshold and the second threshold may be the same value or different values.

Figure 8A:
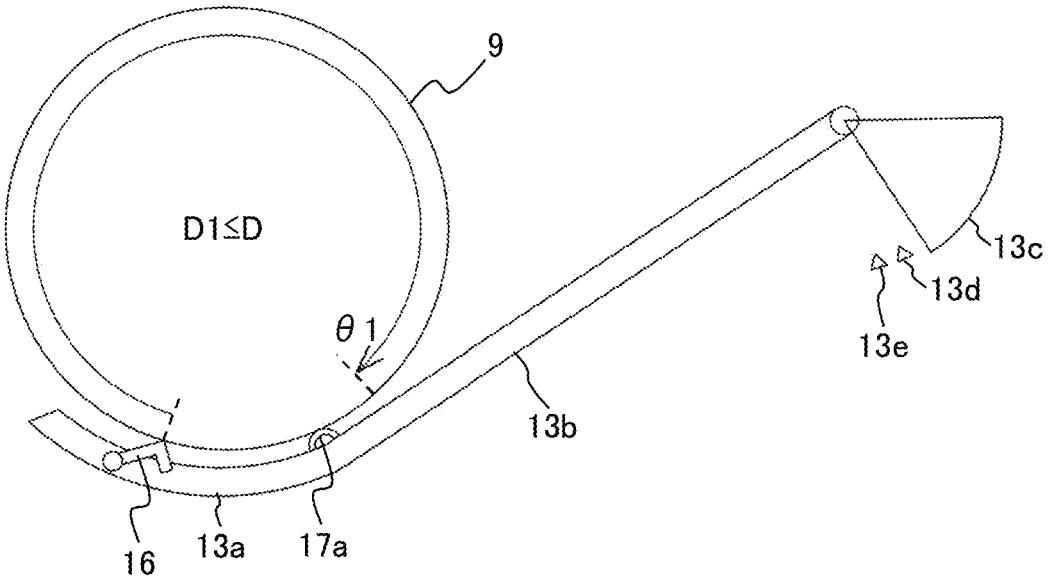
FIGS. 8A to 8C are diagrams illustrating a relation among an outer diameter of a roll, a rotation angle up to a feeding start position, and positions of a detected portion and an outer diameter sensor in the sheet feeding device.
Figure 8B:
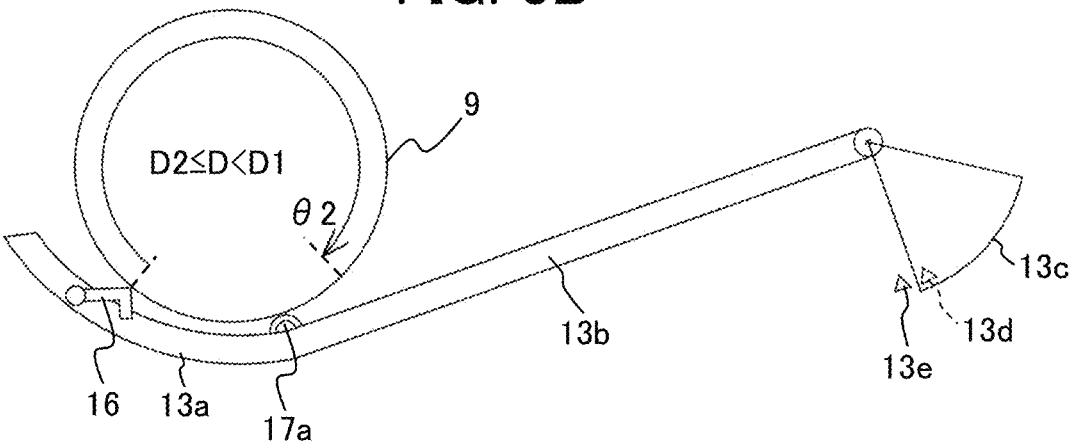
Figure 8C:
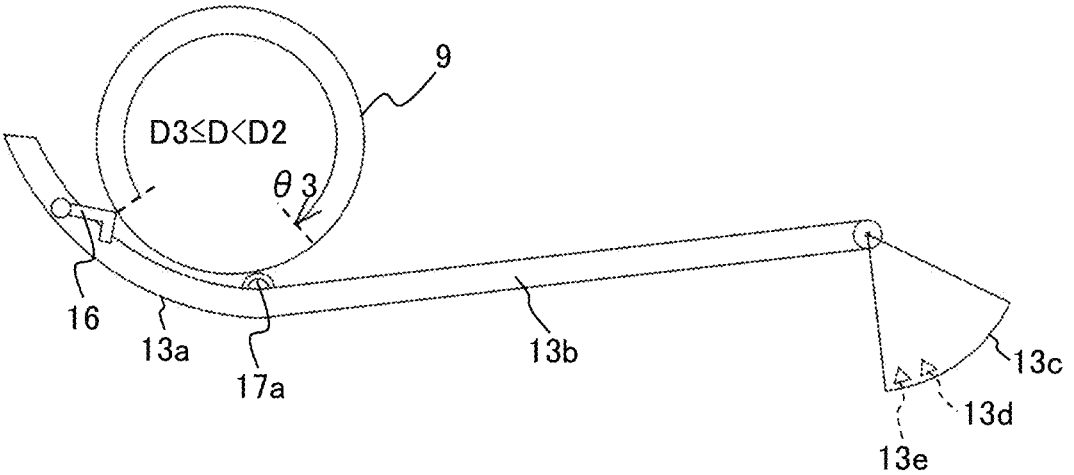

Next, with reference to FIGS. 8A to 8C, a description is given of a rotation angle θ from the leading end sensor 16 to the feeding start position and a positional relation between the detected portion 13*c* and the outer diameter sensors 13*d* and 13*e* when the outer diameter D of the roll 9 changes. FIGS. 8A to 8C are diagrams illustrating a relation among the outer diameter D of the roll 9, the rotation angle θ up to the feeding start position, and positions of the detected portion 13*c* and the outer diameter sensors 13*d* and 13*e*.

As illustrated in FIG. 8A, when the outer diameter D of the roll 9 is equal to or greater than a first dimension D1, the feeding start position is separated from the leading end sensor 16 by a rotation angle θ1 in the winding direction. The detected portion 13*c* does not block the optical paths of both the outer diameter sensors 13*d* and 13*e*. That is, neither of the outer diameter sensors 13*d* and 13*e* outputs the detection signal.

As illustrated in FIG. 8B, when the outer diameter D of the roll 9 is less than the first dimension D1 and equal to or greater than a second dimension D2, the feeding start position is separated from the leading end sensor 16 by a rotation angle θ2 in the winding direction. The detected portion 13*c* blocks the optical path of the outer diameter sensor 13*d* and does not block the optical path of the outer diameter sensor 13*e*. That is, the outer diameter sensor 13*d* outputs the detection signal, and the outer diameter sensor 13*e* does not output the detection signal.

As illustrated in FIG. 8C, when the outer diameter D of the roll 9 is less than the second dimension D2 and equal to or greater than a third dimension D3, the feeding start position is separated from the leading end sensor 16 by a rotation angle θ3 in the winding direction. The detected portion 13*c* blocks the optical paths of both the outer diameter sensors 13*d* and 13*e*. That is, both the outer diameter sensors 13*d* and 13*e* output the detection signal.

Here, $D1>D2>D3$, and $\theta1>\theta2>\theta3$. That is, as the outer diameter D of the roll 9 increases, the rotation angle θ in the winding direction from the leading end sensor 16 to the feeding start position increases. In other words, as the outer diameter D of the roll 9 decreases, the rotation angle θ in the winding direction from the leading end sensor 16 to the feeding start position decreases. In the present embodiment, as illustrated in FIG. 15, the rotation angles θ1=355°, θ2=350°, and θ3=345°, but are not limited thereto.

The controller 50 determines that $D1\leq D$ (hereinafter referred to as the outer diameter D is "large") when neither of the outer diameter sensors 13*d* and 13*e* outputs the detection signal. The controller 50 determines that $D2\leq D<D1$ (hereinafter referred to as the outer diameter D is "medium") when the outer diameter sensor 13*d* outputs the detection signal and the outer diameter sensor 13*e* does not output the detection signal. The controller 50 determines that $D3\leq D<D2$ (hereinafter referred to as the outer diameter D is "small") when both the outer diameter sensors 13*d* and 13*e* output the detection signal.

Figure 9:
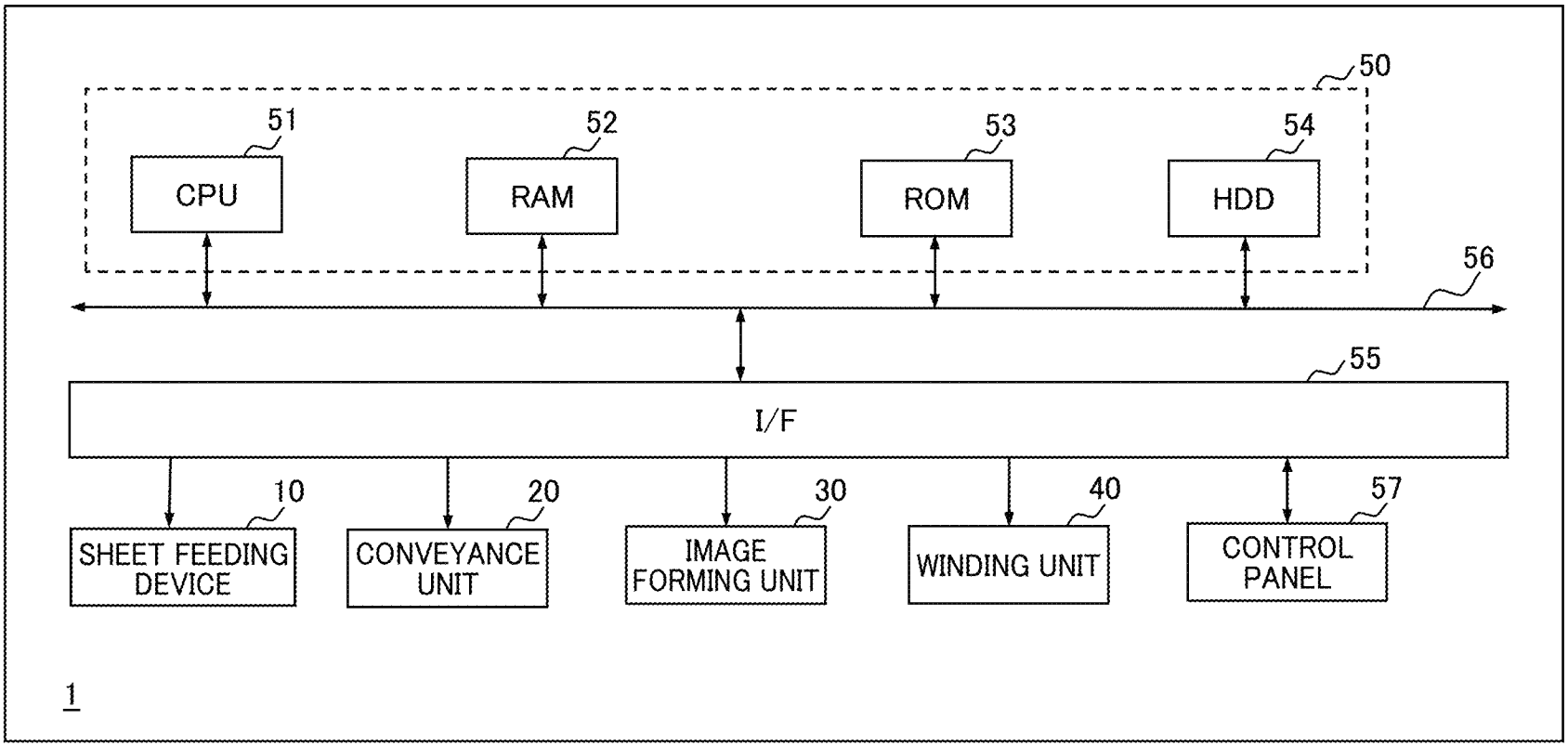
FIG. 9 is a schematic block diagram illustrating a hardware configuration of the image forming apparatus.

FIG. 9 is a schematic block diagram illustrating a hardware configuration of the image forming apparatus 1. As illustrated in FIG. 9, the image forming apparatus 1 includes a central processing unit (CPU) 51 as a control device, a random access memory (RAM) 52 as a storage device, a read only memory (ROM) 53 as a storage device, a hard disk drive (HDD) 54 as a storage device, and an interface (I/F) 55, which are connected via a common bus 56 as a communication device. The CPU 51, the RAM 52, the ROM 53, and the HDD 54 are examples of the controller 50 as circuitry.

The CPU 51 is an arithmetic device and controls the overall operation of the image forming apparatus 1. The RAM 52 is a volatile storage medium in which data is read and written at high speed and used as a working area when the CPU 51 processes data. The ROM 53 is a non-volatile read only storage medium and stores programs such as firmware. The HDD 54 is a non-volatile storage medium with large storage capacity, in which data is read and written, and stores an operating system (OS), various control programs, application programs, and the like.

The image forming apparatus 1 processes various programs loaded from the ROM 53 or the HDD 54 to the RAM 52 by arithmetic functions provided in the CPU 51. By this processing, a software control unit including various functional modules of the image forming apparatus 1 is configured. The software control unit thus configured and the hardware resources installed in the image forming apparatus 1, in combination, construct functional blocks that implement the function of the image forming apparatus 1.

The I/F 55 connects the sheet feeding device 10, the conveyance unit 20, the image forming unit 30, the winding unit 40, and a control panel (input unit) 57 to the common bus 56. That is, the controller 50 controls the sheet feeding device 10, the conveyance unit 20, the image forming unit 30, the winding unit 40, and the control panel 57 via the I/F 55.

The control panel 57 is a user interface including a display that displays various types of information to be indicated to an operator, and buttons, switches, dials, and the like that accept operations by the operator. The control panel 57 may include a touch panel overlaid on the display. The control panel 57 accepts the operation by the operator and outputs an operation signal corresponding to the accepted operation to the controller 50.

Figure 10:
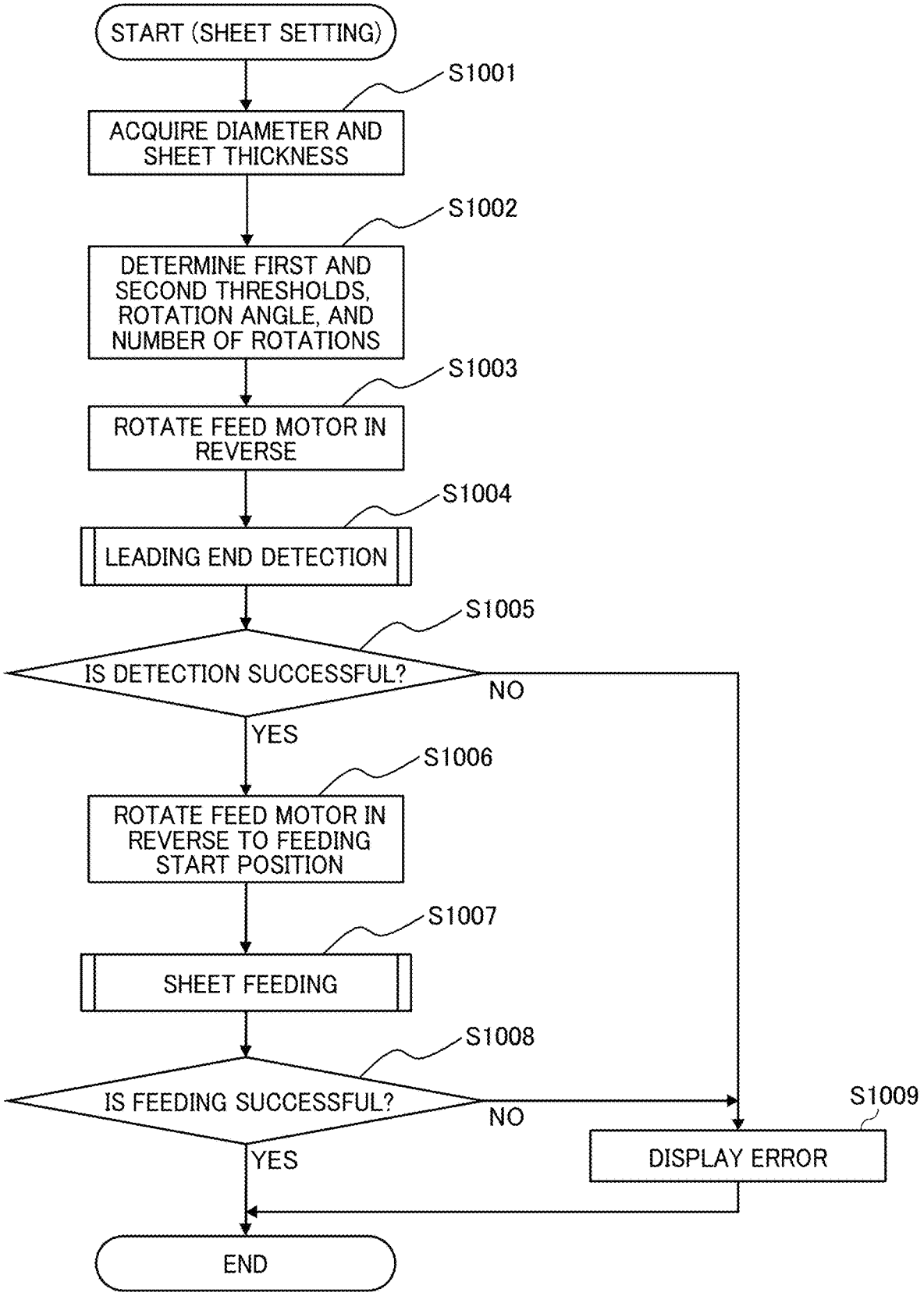
FIG. 10 is a flowchart of a sheet setting process of the sheet feeding device.

Next, a sheet setting process is described with reference to FIG. 10. FIG. 10 is a flowchart of the sheet setting process. In the sheet setting process, when a new roll 9 is mounted on the support 11, the continuous sheet P of the roll 9 is fed to the conveyance unit 20 through between the guide plates 18*a* and 18*b*. The controller 50 controls the feed motor 12 based on the signal change rate of the leading end sensor 16 and the detection result of the outer diameter sensors 13*d* and 13*e*. The sheet setting process starts, for example, when a sensor detects that the roll 9 is mounted on the sheet feeding device 10 or when the control panel 57 accepts an operation indicating that the roll 9 has been replaced.

First, the controller 50 acquires the outer diameter D of the roll 9 and the thickness of the continuous sheet P (hereinafter referred to as a "sheet thickness w") (S1001). More specifically, the controller 50 acquires the outer diameter D of the roll 9, for example, any one of "small", "medium", and "large", based on the detection signals of the outer diameter sensors 13*d* and 13*e*. Further, the controller 50 acquires the sheet thickness w, for example, any one of "thin paper", "plain paper", and "thick paper", input by an operator through the control panel 57.

Next, the controller 50 determines the first threshold, the second threshold, the rotation angle θ, and the number of rotations S based on the outer diameter D and the sheet thickness w acquired in step S1001 (S1002). The first threshold and the second threshold are change rate thresholds to be compared with signal change rates in a leading end detection process and an alternative detection process described later. The rotation angle θ indicates the rotation angle of the spool 8 in step S1006 described later. The number of rotations S indicates the number of rotations of the spool 8 in a sheet feeding process described later.

The controller 50 determines the first threshold, the second threshold, the rotation angle θ, and the number of rotations S based on, for example, a table illustrated in FIG. 15. FIG. 15 is a table illustrating a relation between the outer diameter D and the sheet thickness W, and the first threshold, the second threshold, the rotation angle θ, and the number of rotations S. The table illustrated in FIG. 15 is stored in, for example, the HDD 54. The controller 50 reads the first threshold, the second threshold, the rotation angle θ, and the number of rotations S corresponding to the outer diameter D and the sheet thickness w acquired in step S1001 from the table as illustrated in FIG. 15.

As illustrated in FIG. 15, the first threshold and the second threshold increase as the outer diameter D increases, and decrease as the outer diameter D decreases. Further, the first threshold and the second threshold increase as the sheet thickness w increases, and decrease as the sheet thickness w decreases. The first threshold and the second threshold corresponding to the same outer diameter D and the same sheet thickness w may be the same value or different values. That is, the controller 50 changes the first threshold and the second threshold based on the outer diameter D and the sheet thickness w.

As illustrated in FIG. 15, the rotation angle θ increases as the outer diameter D increases, and decreases as the outer diameter D decreases. Further, as illustrated in FIG. 15, the number of rotations S decreases as the outer diameter D increases, and increases as the outer diameter D decreases. That is, the controller 50 changes the rotation angle θ and the number of rotations S based on the outer diameter D.

Next, the controller 50 rotates the feed motor 12 in reverse to rotate the spool 8 in the winding direction (S1003). In addition, the controller 50 executes the leading end detection process described later while rotating the feed motor 12 in the reverse (S1004). Then, the controller 50 determines whether the detection of the leading end of the continuous sheet P is successful in the leading end detection process (S1005).

When the controller 50 determines that the detection of the leading end of the continuous sheet P is successful (Yes in S1005), the controller 50 causes the feed motor 12 to rotate in reverse to rotate the spool 8 in the winding direction by the rotation angle θ determined in step S1002 from a passing time determined in the leading end detection process (S1006). Thus, the leading end of the continuous sheet P reaches a feeding start position.

The passing time indicates when the leading end of the continuous sheet P passes through the leading end sensor 16. The feeding start position indicates a position upstream from the leading end sensor 16 and the rollers 17*a* and 17*b* in the winding direction and facing the guide portion 13*b*. In other words, the feeding start position is a position where the continuous sheet P is fed toward the guide plates 18*a* and 18*b* along the guide portion 13*b* when the spool 8 rotates in the feeding direction.

Next, the controller 50 executes the sheet feeding process described later (S1007). In the sheet feeding process, the leading end of the continuous sheet P wound around the spool 8 reaches the conveyance unit 20. Then, the controller 50 determines whether the leading end of the continuous sheet P reaches the conveyance unit 20, that is, feeding is successful or not, in the sheet feeding process (S1008). When the controller 50 determines that feeding is successful (Yes in S1008), the controller 50 normally ends the sheet setting process.

After finishing the sheet setting process normally, the image forming apparatus 1 can execute an image forming process to form an image on the continuous sheet P. That is, the controller 50 drives the conveyance motor 23 to convey the continuous sheet P to a position facing the recording heads 31*k*, 31*c*, 31*m*, and 31*y*. Next, the controller 50 drives the main scanning motor 32 to move the carriage 31 in the main scanning direction and causes the recording heads 31*k*, 31*c*, 31*m*, and 31*y* to discharge ink. By repeating this process, an image is recorded on the continuous sheet P. Further, the controller 50 drives the winding motor 42 to wind the continuous sheet P on which the image is recorded around the winding roller 41.

On the other hand, when the controller 50 determines that the detection of the leading end of the continuous sheet P fails (No in S1005), the controller 50 stops the feed motor 12 and displays an error on the control panel 57 (S1009). Similarly, when the controller 50 determines that the feeding of the continuous sheet P fails (No in S1008), the controller 50 stops the feed motor 12 and displays an error on the control panel 57 (S1009). The operator performs an appropriate operation (for example, remounting of the roll 9) according to the content of the error displayed on the control panel 57. Then, the controller 50 ends the sheet setting process as failure.

Figure 11:
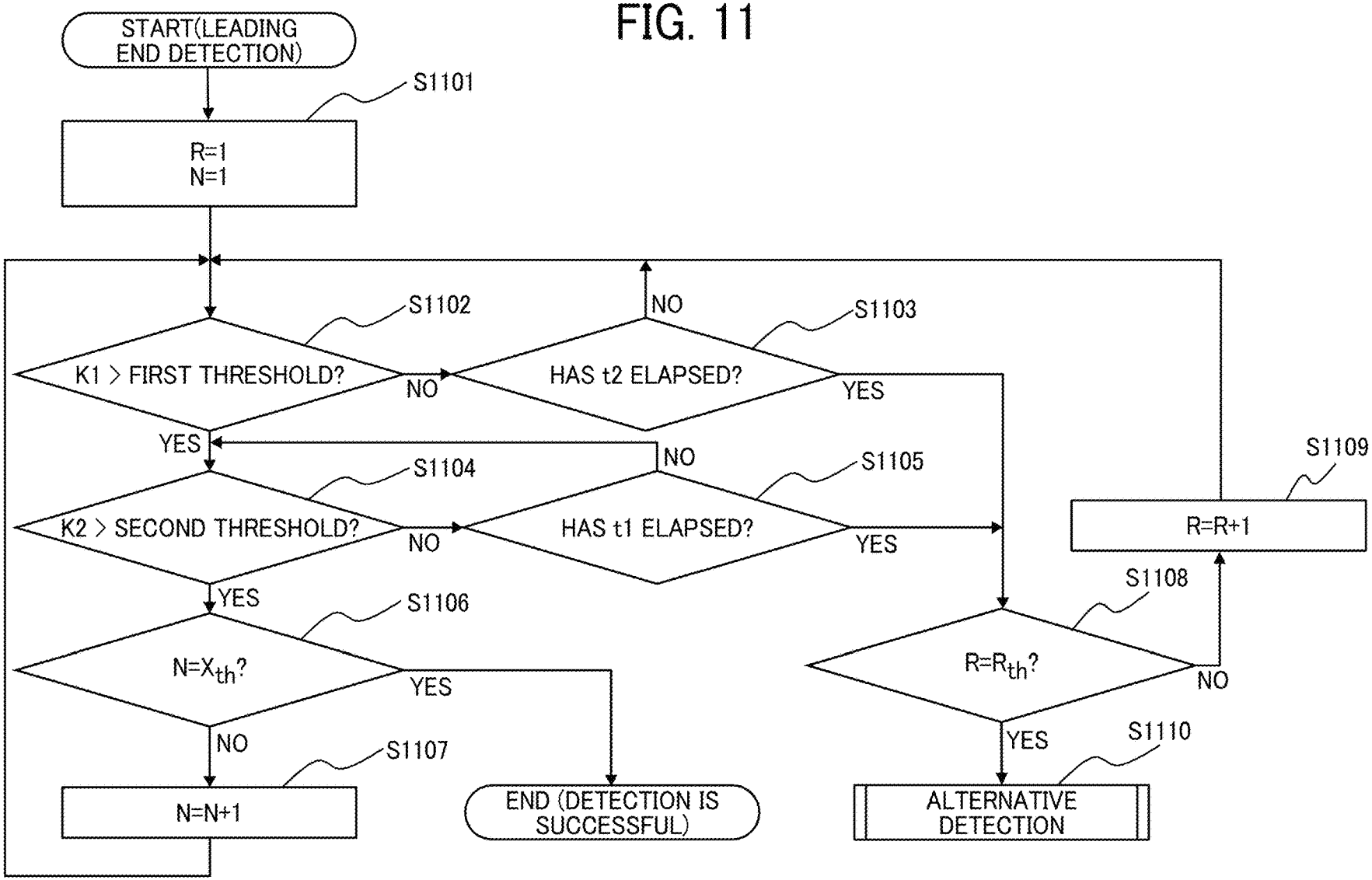
FIG. 11 is a flowchart of a leading end detection process of the sheet feeding device.
Figure 12:
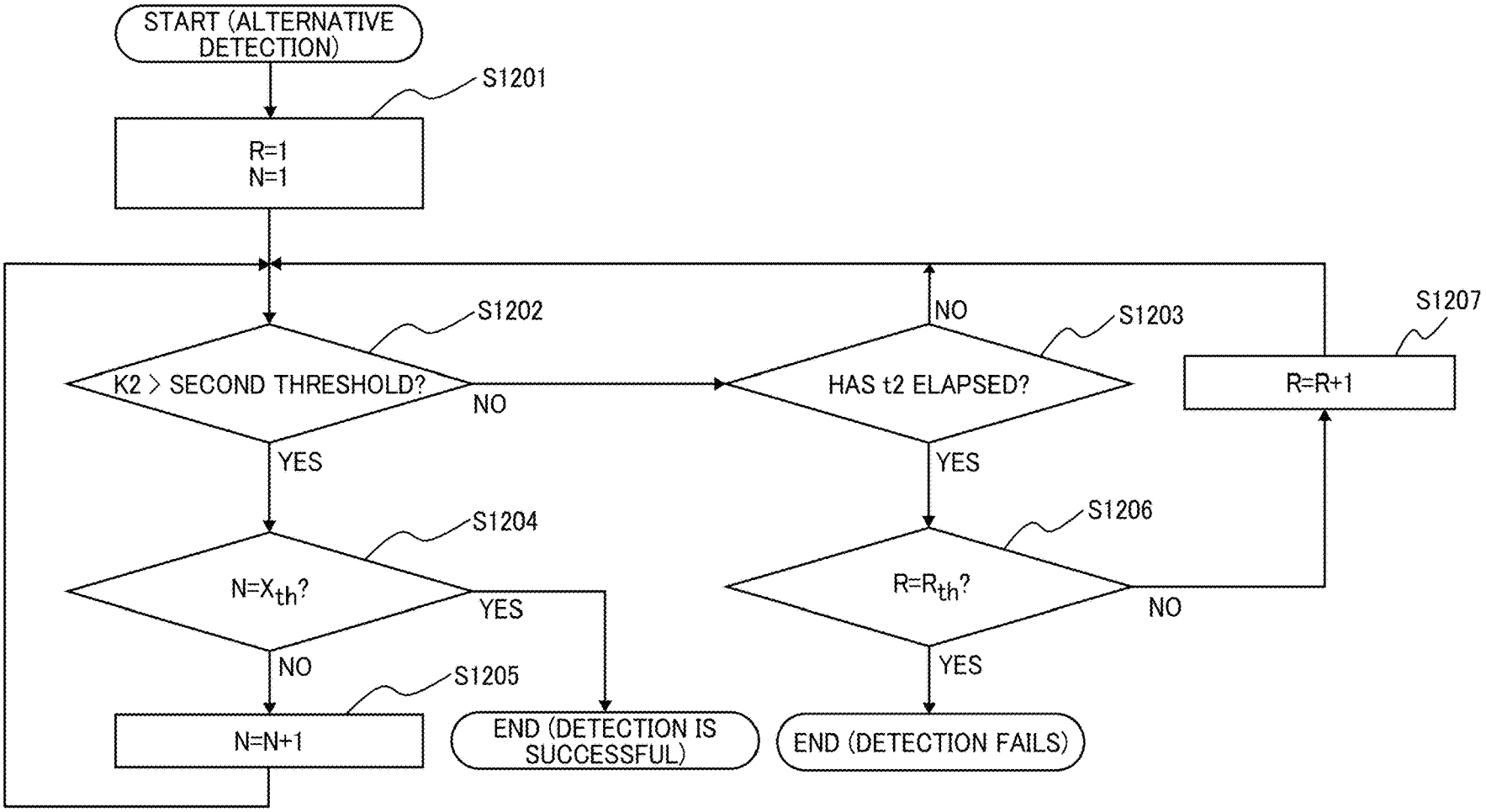
FIG. 12 is a flowchart of an alternative detection process of the sheet feeding device.
Figure 13:
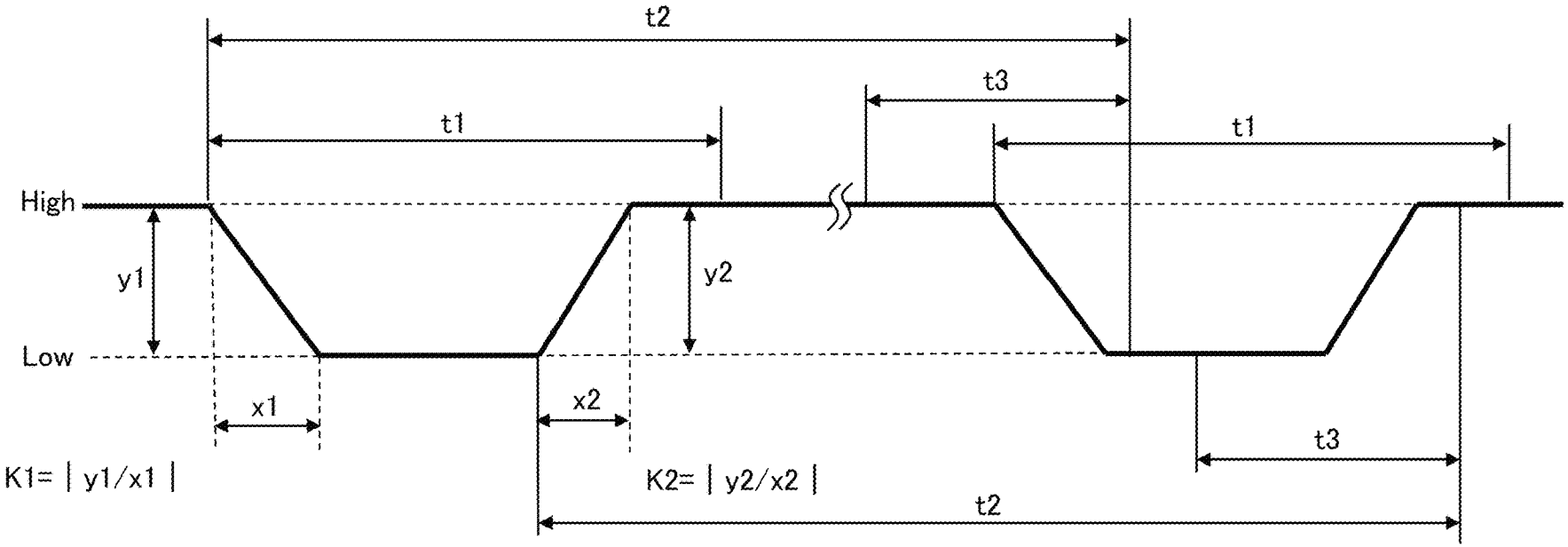
FIG. 13 is a diagram illustrating the change of the signal level of the detection signal in the leading end detection process.

Next, with reference to FIGS. 11 to 13, a description is given of the leading end detection process of detecting the leading end of the continuous sheet P in step S1004 illustrated in FIG. 10. FIG. 11 is a flowchart of the leading end detection process. FIG. 12 is a flowchart of the alternative detection process. FIG. 13 is a diagram illustrating the change of the signal level of the detection signal in the leading end detection process. During the leading end detection process and the alternative detection process, the spool 8 rotates in the winding direction.

In the leading end detection process illustrated in FIG. 11, the controller 50 determines the passing time based on both the first change rate K1 and the second change rate K2. On the other hand, in the alternative detection process illustrated in FIG. 12, the controller 50 determines the passing time based on only the second change rate K2. In the present embodiment, first, the controller 50 determines the passing time in the leading end detection process, and when the controller 50 fails to detect the passing time in the leading end detection process, the controller 50 executes the alternative detection process. Note that the leading end detection process and the alternative detection process may be performed independently.

First, the controller 50 initializes variables R and N stored in RAM 52 to 1 (S1101). The variable R represents the number of rotations of the spool 8 in the leading end detection process. The variable N represents the number of times the controller 50 determines the passing time in the leading end detection process.

Next, the controller 50 waits for subsequent processing until the first change rate K1 of the detection signal exceeds the first threshold determined in step S1002 (S1102) or until the second time t2 elapses (S1103). The controller 50 determines that the leading end of the continuous sheet P has passed through the rollers 17*a* and 17*b* when the first change rate K1 exceeds the first threshold during a predetermined third time range t3 (Yes in S1102) until the second time t2 elapses (No in S1103).

Next, when the controller 50 determines that the leading of the continuous sheet P has passed through the rollers 17*a* and 17*b* (Yes in S1102), the controller 50 waits for subsequent processing until the second change rate K2 of the detection signal exceeds the second threshold determined in step S1002 (S1104) or the first time t1 elapses (S1105). When the second change rate K2 exceeds the second threshold (Yes in S1104) before the first time t1 elapses (No in S1105), the controller 50 determines that the leading end of the continuous sheet P has passed the leading end sensor 16.

As illustrated in FIG. 13, the first time t1 is a predetermined time corresponding to a separation distance between the leading end sensor 16 and the rollers 17*a* and 17*b*. More specifically, the first time t1 is a time required for the roll 9 to rotate by the separation distance with a margin added. The second time t2 is a predetermined time corresponding to one rotation of the roll 9. More specifically, the second time t2 is a time required for the roll 9 to make one rotation with a positive margin added. The third time range t3 is a predetermined time range included in the second time t2. Specifically, the third time range t3 is a time range between the timing at which the second time t2 elapses (the end of the second time t2) and a time going back a predetermined time from the end of the second time t2. More specifically, the third time range t3 is a time range including positive and negative margins with respect to the timing at which the leading end of the continuous sheet P is assumed to pass through the leading end sensor 16 in the second time t2.

The controller 50 determines the timing at which the second change rate K2 exceeds the second threshold (Yes in S1104) as the passing time until the first time t1 elapses (No in S1105) after the first change rate K1 exceeds the first threshold (Yes in S1102). When the controller 50 determines the passing time, the controller 50 compares the variable N with a determination threshold $X_{th}$ (S1106).

Then, when the variable N is less than the determination threshold $X_{th}$ (No in S1106), the controller 50 increments the variable N by 1 (S1107) and executes the processing from step S1102 again. When the variable N reaches the determination threshold $X_{th}$ (Yes in S1106), the controller 50 determines that the detection of the leading end of the continuous sheet P is successful and ends the leading end detection process.

That is, when the controller 50 determines the passing time within the third time range t3 included in the second time of each time of $X_{th}$ times (Yes in S1104) while the second time t2 elapses $X_{th}$ times (No in S1106), the controller 50 executes the processing in step S1006 at the $X_{th}$-th passing time. The determination threshold $X_{th}$ is a value to determine whether the number of times the controller 50 detects the leading end of the continuous sheet P exceeds a predetermined number of times. The determination threshold $X_{th}$ may be a certain fixed number, or may be a value of N input through the control panel 57. The determination threshold $X_{th}$ is an integer that may be 1, or 2 or more.

On the other hand, when the second time t2 has elapsed before the first change rate K1 exceeds the first threshold (No in S1102 and Yes in S1103) or when the first change rate K1 exceeds the first threshold outside the third time range t3, the controller 50 compares the variable R with a rotation threshold $R_{th}$ (S1108). Similarly, when the first time t1 has elapsed (Yes in S1105) before the second change rate K2 exceeds the second threshold (No in S1104), the controller 50 compares the variable R with the rotation threshold $R_{th}$ (S1108).

Then, when the variable R is less than the rotation threshold $R_{th}$ (No in S1108), the controller 50 increments the variable R by 1 (S1109) and executes the processing from step S1102 again. When the variable R reaches the rotation threshold $R_{th}$ (Yes in S1108), the controller 50 determines that the detection of the leading end of the continuous sheet P in the leading end detection process fails and executes the alternative detection process (S1110).

That is, when the controller 50 fails to detect the first change rate K1 and the second change rate K2 (No in S1102 and No in S1104) until the roll 9 rotates $R_{th}$ times in the winding direction (No in S1108), the controller 50 executes the alternative detection process (S1110). The rotation threshold $R_{th}$ is a value to determine whether the number of times the controller 50 fails to detect the leading end of the continuous sheet P exceeds a predetermined number of times from the start of the leading end detection process (S1101) to the alternative detection process (S1110). The rotation threshold $R_{th}$ may be a predetermined fixed number, or may be a value of R input through the control panel 57. The rotation threshold $R_{th}$ is an integer that may be 1, or 2 or more.

As illustrated in FIG. 12, the controller 50 initializes variables R and N stored in RAM 52 to 1 (S1201). The definitions of the variables R and N, the determination threshold $X_{th}$, and the rotation threshold $R_{th}$ are the same as the above-described definitions in the leading end detection process.

Next, the controller 50 waits for subsequent processing until the second change rate K2 of the detection signal exceeds the second threshold determined in step S1002 (S1202) or until the second time t2 elapses (S1203). The controller 50 determines that the leading end of the continuous sheet P has passed through the leading end sensor 16, that is, the passing time when the second change rate K2 exceeds the second threshold within the predetermined third time range t3 (Yes in S1202) until the second time t2 elapses (No in S1203).

When the controller 50 determines the passing time (Yes in S1202), the controller 50 compares the variable N with the determination threshold $X_{th}$ (S1204). Then, when the variable N is less than the determination threshold $X_{th}$ (No in S1204), the controller 50 increments the variable N by 1 (S1205) and executes the processing from step S1202 again. When the variable N reaches the determination threshold $X_{th}$ (Yes in S1204), the controller 50 determines that the detection of the leading end of the continuous sheet P is successful and ends the alternative detection process. That is, when the second change rate K2 exceeds the second threshold within the third time range t3 included in the second time t2 of each time of $X_{th}$ times while the second time t2 elapses $X_{th}$ times (No in S1204), the controller 50 determines the timing at which the second change rate K2 exceeds the second threshold $X_{th}$ times as the passing time.

On the other hand, when the second time t2 has elapsed before the second change rate K2 exceeds the second threshold (No in S1202 and Yes in S1203) or when the second change rate K2 exceeds the second threshold outside the third time range t3, the controller 50 compares the variable R with the rotation threshold $R_{th}$ (S1206). Then, when the variable R is less than the rotation threshold $R_{th}$ (No in S1206), the controller 50 increments the variable R by 1 (S1207) and executes the processing from step S1202 again. When the variable R reaches the rotation threshold $R_{th}$ (Yes in S1206), the controller 50 determines that the detection of the leading end of the continuous sheet P in the alternative detection process fails and ends the alternative detection process.

Figure 14:
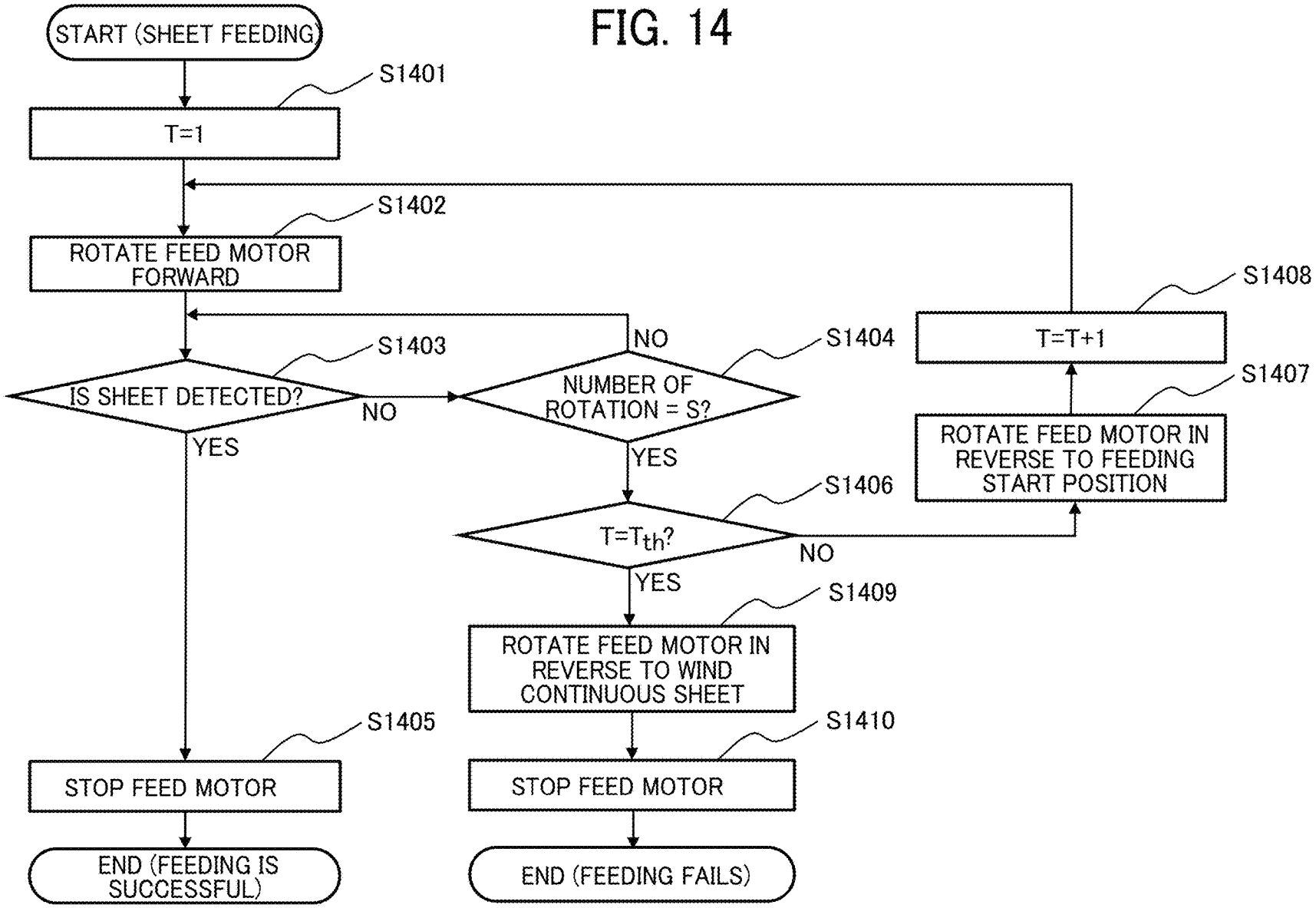
FIG. 14 is a flowchart of a sheet feeding process of the sheet feeding device.

Next, with reference to FIG. 14, a description is given of the sheet feeding process of causing the leading end of the continuous sheet P to reach the conveyance unit 20 in step S1007 illustrated in FIG. 10. FIG. 14 is a flowchart of the sheet feeding process.

First, the controller 50 initializes a variable T stored in RAM 52 to 1 (S1401). The variable T represents the number of repetitions of the processing from step S1402 to step S1408 that causes the leading edge of the continuous sheet P to reach the conveyance unit 20.

Next, the controller 50 causes the feed motor 12 to rotate forward to feed the continuous sheet P from the feeding start position along the guide portion 13*b* (S1402). Then, the controller 50 continues rotating the feed motor 12 forward until the sheet detection sensor 19 detects the leading end of the continuous sheet P (S1403) or the spool 8 rotates the number of rotations S determined in the step S1002 (S1404).

Next, when the sheet detection sensor 19 detects the continuous sheet P (Yes in S1403) before the spool 8 rotates the number of rotations S (No in S1404), the controller 50 determines that the continuous sheet P passes between the guide plates 18*a* and 18*b*.

The controller 50 rotates the spool 8 by a predetermined rotation angle from the time when the sheet detection sensor 19 starts outputting the detection signal (i.e., when the leading end of the continuous sheet P reaches the installation position of the sheet detection sensor 19) to deliver the continuous sheet P to the conveyance unit 20 in which the leading end of the continuous sheet P is nipped by the conveyance roller 21 and the pressure roller 22. Then, the controller 50 stops the feed motor 12 (S1405). The predetermined rotation angle corresponds to the distance from the installation position of the sheet detection sensor 19 to the conveyance unit 20. Then, the controller 50 determines that the continuous sheet P has been successfully fed to the conveyance unit 20 (i.e., feeding is successful), and ends the sheet feeding process.

On the other hand, there may be a case in which the leading end of the continuous sheet P is caught by the guide plates 18*a* and 18*b*, and does not enter between the guide plates 18*a* and 18*b*. In this case, if the feed motor 12 continues rotating forward, the continuous sheet P jammed in the conveyance path L may be bent or torn.

Therefore, when the spool 8 rotates the number of rotations S (Yes in S1404) before the sheet detection sensor 19 detects the continuous sheet P (No in S1403), the controller 50 compares the variable T with a repetition threshold (number of repetitions) $T_{th}$ (S1406). The repetition threshold $T_{th}$ is the number of times the continuous sheet P is repeatedly fed to the conveyance unit 20. The repetition threshold $T_{th}$ may be a predetermined fixed number, or may be a value of $T_{th}$ input through the control panel 57. The repetition threshold $T_{th}$ is an integer that may be 1, or 2 or more.

Next, when the variable T is less than the repetition threshold $T_{th}$ (No in S1406), the controller 50 rotates the feed motor 12 in reverse to wind the continuous sheet P fed in feeding direction toward the conveyance unit 20 around the spool 8, and causes the leading end of the continuous sheet P to reach the feeding start position again (S1407). That is, the controller 50 rotates the feed motor 12 in reverse until the spool 8 rotates the number of rotations S in the step S1407.

Then, the controller 50 increments the variable T by 1 (S1408) and executes the processing from step S1402 again. When the variable T reaches the repetition threshold $T_{th}$ (Yes in S1406), the controller 50 determines that the continuous sheet P is jammed in the conveyance path L. Then, the controller 50 rotates the feed motor 12 in reverse to wind the continuous sheet P fed in the feeding direction around the spool 8 (S1409). The controller 50 stops the feed motor 12 after rotating the spool 8 the number of rotations S or more (S1410). Then, the controller 50 determines that the feeding of the continuous sheet P to the conveyance unit 20 fails, and ends the sheet feeding process.

According to the above-described embodiment, the following operational effects, for example, are achieved.

According to the above-described embodiment, the leading end of the continuous sheet P is detected in a state in which the leading end is in close contact with the outer circumferential surface of the roll 9. Therefore, the leading end of the continuous sheet P can be stably detected regardless of the thickness, stiffness, and curl of the continuous sheet P. As the roll 9 is just mounted on the support 11, the leading end is automatically detected and inserted between the guide plates 18*a* and 18*b*. Thus, the continuous sheet P can be stably inserted between the guide plates 18*a* and 18*b* compared with the case in which an operator manually inserts the continuous sheet P.

Further, according to the above-described embodiment, the controller 50 determines the timing at which the second change rate K2 exceeds the second threshold as the passing time until the first time t1 elapses after the first change rate K1 exceeds the first threshold. Accordingly, the controller 50 does not erroneously detect the unevenness of the roll 9 as the leading end of the continuous sheet P.

Further, according to the above-described embodiment, the controller 50 repeatedly detects the leading end of the continuous sheet P $X_{th}$ times, thereby improving the accuracy of detection. Further, the operator can set the determination threshold $X_{th}$ large when the continuous sheet P is thin, and small when the continuous sheet P is thick, for example. As a result, the accuracy and throughput of the detection are compatible with each other.

When the leading end of the continuous sheet P is inclined with respect to the feeding direction, the first change rate K1 when the leading end of the continuous sheet P passes through the rollers 17*a* and 17*b* is likely to decrease. As described in the above embodiment, when the controller 50 does not appropriately detect the leading end of the continuous sheet P in the leading end detection process, the controller 50 executes the alternative detection process. Accordingly, the controller 50 can appropriately detect the leading end of the continuous sheet P regardless of the degree of inclination of the continuous sheet P.

Here, an amount of displacement per unit time (hereinafter referred to as a "linear velocity") of the leading end of the continuous sheet P changes depending on the outer diameter D of the roll 9. As described in the above embodiment, the sheet feeding device 10 changes the first threshold and the second threshold according to the outer diameter D of the roll 9, thereby preventing erroneous detection of the leading end of the continuous sheet P.

More specifically, the linear velocity of the leading end of the continuous sheet P increases as the outer diameter D increases, and decreases as the outer diameter D decreases. Therefore, as illustrated in FIG. 15, preferably, the controller 50 increases the first threshold and the second threshold as the outer diameter D increases, and decreases the first threshold and the second threshold as the outer diameter D decreases.

Similarly, the signal change rate when the leading end of the continuous sheet P passes through the leading end sensor 16 and the rollers 17*a* and 17*b* changes depending on the sheet thickness w of the continuous sheet P. As described in the above embodiment, the controller 50 changes the first threshold and the second threshold according to the sheet thickness w of the continuous sheet P, thereby preventing erroneous detection of the leading end of the continuous sheet P.

More specifically, the signal change rate of the leading end sensor 16 increases as the sheet thickness w increases, and decreases as the sheet thickness w decreases. Therefore, as illustrated in FIG. 15, preferably, the controller 50 increases the first threshold and the second threshold as the sheet thickness w increases, and decreases the first threshold and the second threshold as the sheet thickness w decreases.

Further, as described in the above embodiment, the controller 50 changes the first threshold and the second threshold based on both the outer diameter D and the sheet thickness w. Thus, the sheet feeding device 10 can appropriately detect the leading end of the continuous sheet P of various types and in various states. However, the controller 50 does not necessarily change the first threshold and the second threshold based on both the outer diameter D and the sheet thickness w, and may change the first threshold and the second threshold based on one of the outer diameter D and the sheet thickness w.

The signal change rate of the leading end sensor 16 may behave differently between when the leading end of the continuous sheet P passes through the leading end sensor 16 and when the leading end of the continuous sheet P passes through the rollers 17*a* and 17*b*. Therefore, as described in the above embodiment, the controller 50 can set the first threshold and the second threshold to different values to appropriately detect the leading end of the continuous sheet P.

The rotation angle θ in the winding direction from the leading end sensor 16 to the feeding start position varies depending on the outer diameter D of the roll 9. Further, the number of rotations S at which the spool 8 rotates so that the leading end of the continuous sheet P reaches the conveyance unit 20 from the feeding start position varies depending on the outer diameter D of the roll 9. Therefore, as described in the above embodiment, the controller 50 can change the rotation angle θ and the number of rotations S according to the outer diameter D to accurately detect jam of the continuous sheet P.

Further, when the jam occurs, the continuous sheet P is wound once and fed again, thereby completing the sheet setting process without increasing the workload of the operator. In addition, according to the above-described embodiment, the operator can set the repetition threshold $T_{th}$ of steps S1402 to S1408 to appropriately adjust the waiting time of the sheet setting process.

When the sheet feeding device 10 fails to feed the continuous sheet P to the conveyance unit 20 even if steps S1402 to S1408 are repeated by the repetition threshold $T_{th}$, the controller 50 displays an error on the control panel 57 to inform the operator that feeding of the continuous sheet P fails. In addition, the sheet feeding device 10 winds the continuous sheet P, which has failed to be fed to the conveyance unit 20, around the roll 9, thereby reducing the workload of the operator to wind the continuous sheet P.

As described above, according to the present disclosure, the sheet feeding device feeds the continuous sheet wound around the spool, and can stably detect the leading end of the continuous sheet regardless of the type of the continuous sheet.

Note that the present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

What is claimed is:

1. A sheet feeding device comprising:

a support configured to detachably support a roll formed of a continuous sheet wound around a spool;

a rotation driver configured to rotate the spool supported by the support in a feeding direction and a winding direction of the continuous sheet;

a guide including:

a facing portion configured to face an outer circumferential surface of the roll; and a guide portion extending downstream from the facing portion in the feeding direction;

a support shaft configured to swingably support the guide around a downstream end of the guide in the feeding direction, in a direction in which the facing portion contacts and separates from the roll;

a biasing member configured to press the guide in a direction in which the facing portion approaches the roll;

a leading end sensor configured to:

retractably project from the facing portion toward the roll to contact the roll; and output a detection signal having a signal level in response to an amount of projection of the leading end sensor;

a roller supported by the facing portion, the roller configured to contact the outer circumferential surface of the roll at a different position from the leading end sensor in a circumferential direction of the roll;

an outer diameter sensor configured to detect an outer diameter of the roll; and circuitry configured to:

control the rotation driver based on a signal change rate that is an amount of change in the signal level of the detection signal per unit time and a detection result of the outer diameter sensor;

cause the rotation driver to rotate the spool in the winding direction to determine a timing at which the signal change rate of the leading end sensor exceeds a change rate threshold as a passing time at which a leading end of the continuous sheet passes through the leading end sensor;

cause the rotation driver to rotate the spool by a rotation angle in the winding direction, from the passing time, to position the leading end at a feeding start position that is upstream from the leading end sensor and the roller in the winding direction and facing the guide portion;

cause the rotation driver to rotate the spool in the feeding direction to feed the continuous sheet from the feeding start position along the guide portion; and change the change rate threshold based on the outer diameter of the roll detected by the outer diameter sensor.

2. The sheet feeding device according to claim 1, wherein the circuitry is configured to decrease the change rate threshold as the outer diameter of the roll detected by the outer diameter sensor decreases.

3. The sheet feeding device according to claim 1, wherein the circuitry is configured to determine the passing time based on a first change rate that is the signal change rate when the leading end sensor retracts and a second change rate that is the signal change rate when the leading end sensor projects, and wherein the circuitry is configured to change a first threshold that is the change rate threshold compared with the first change rate and a second threshold that is the change rate threshold compared with the second change rate based on the outer diameter of the roll detected by the outer diameter sensor.

4. The sheet feeding device according to claim 3, wherein the circuitry is configured to set the first threshold and the second threshold to different values.

5. The sheet feeding device according to claim 1, further comprising an input unit configured to accept an operation of inputting a thickness of the continuous sheet, wherein the circuitry is configured to change the change rate threshold based on the outer diameter of the roll detected by the outer diameter sensor and the thickness of the continuous sheet input through the input unit.

6. The sheet feeding device according to claim 5, wherein the circuitry is configured to increase the change rate threshold as the thickness of the continuous sheet input through the input unit increases.

7. The sheet feeding device according to claim 1, wherein the circuitry is configured to decrease the rotation angle as the outer diameter of the roll detected by the outer diameter sensor decreases.

8. The sheet feeding device according to claim 1, wherein the circuitry is configured to increase a number of rotations of the spool in the feeding direction as the outer diameter of the roll detected by the outer diameter sensor decreases.

9. The sheet feeding device according to claim 8, further comprising a sheet detection sensor disposed downstream from the guide portion in the feeding direction and configured to detect the continuous sheet, wherein, when the sheet detection sensor does not detect the continuous sheet while the rotation driver rotates the spool the number of rotations in the feeding direction, the circuitry causes the rotation driver to rotate the spool in the winding direction to wind the continuous sheet fed in the feeding direction around the spool and causes the rotation driver to rotate the spool in the feeding direction again.

10. The sheet feeding device according to claim 9, further comprising an input unit configured to accept an operation of inputting a number of repetitions, wherein the circuitry is configured to cause the rotation driver to repeatedly rotate the spool in the winding direction and the feeding direction to wind and feed the continuous sheet until the sheet detection sensor detects the continuous sheet or up to the number of repetitions input through the input unit.

11. The sheet feeding device according to claim 10, further comprising a conveyance path through which the continuous sheet passes, wherein, when the sheet detection sensor does not detect the continuous sheet while the rotation driver repeatedly rotates the spool in the winding direction and the feeding direction to wind and feed the continuous sheet the number of repetitions, the circuitry determines that the continuous sheet is jammed in the conveyance path.

12. The sheet feeding device according to claim 11, wherein, when the circuitry determines that the continuous sheet is jammed in the conveyance path, the circuitry causes the rotation driver to rotate the spool in the winding direction to wind the continuous sheet fed in the feeding direction around the spool.

13. An image forming apparatus comprising:

the sheet feeding device according to claim 1, configured to feed the continuous sheet; and an image forming unit configured to form an image on the continuous sheet.

* * * * *